US007487655B2

(12) United States Patent
Imamura et al.

(10) Patent No.: US 7,487,655 B2
(45) Date of Patent: Feb. 10, 2009

(54) PROCESS FOR PRODUCING TUBULAR RING WITH BEADS AND DIE FOR USE THEREIN

(75) Inventors: Yoshihaya Imamura, Fujisawa-shi (JP); Noritaka Eguchi, Fujisawa-shi (JP); Takeo Sakurai, Tokyo (JP); Hiroshi Tanimoto, Tokyo (JP)

(73) Assignee: Kobe Steel, Ltd, Kobe-shi (JP)

( * ) Notice: Subject to any disclaimer, the term of this patent is extended or adjusted under 35 U.S.C. 154(b) by 517 days.

(21) Appl. No.: 10/528,430

(22) PCT Filed: Sep. 26, 2003

(86) PCT No.: PCT/JP03/12372

§ 371 (c)(1),
(2), (4) Date: Sep. 21, 2005

(87) PCT Pub. No.: WO2004/028720

PCT Pub. Date: Apr. 8, 2004

(65) Prior Publication Data

US 2006/0107715 A1 May 25, 2006

(30) Foreign Application Priority Data

Sep. 27, 2002 (JP) ..... 2002-283953
Jun. 10, 2003 (JP) ..... 2003-165732

(51) Int. Cl.
*B21D 26/14* (2006.01)

(52) U.S. Cl. ..... 72/56; 72/430; 29/419.2

(58) Field of Classification Search ..... 72/54, 72/55, 56, 57, 58, 430; 29/419.2
See application file for complete search history.

(56) References Cited

U.S. PATENT DOCUMENTS 2,976,907 A * 3/1961 Harvey et al. ..... 72/56
3,345,732 A * 10/1967 Brower ..... 29/419.2

(Continued)

FOREIGN PATENT DOCUMENTS

DE 3215029 12/1982

(Continued)

*Primary Examiner*—David B Jones
(74) *Attorney, Agent, or Firm*—Oblon, Spivak, McClelland, Maier & Neustadt, P.C.

(57) ABSTRACT

A metal mold is disposed adjacent to the outer circumference of a base ring, and has a molding face in the inner circumference and a plurality of grooves for forming beads on the molding face along the circumferential direction. A coil for electromagnetic forming is disposed adjacent to the inner circumference of the base ring. When a momentary large current is applied to the coil in this arrangement, the diameter of the base ring is expanded by pressing the base ring toward the molding face of the metal mold such that the base ring is molded into a shape corresponding to the molding face by electromagnetic forming. Improvements such as a metal mold capable of degassing, a separable metal mold, roll-correcting after electromagnetic forming, application of momentary large current over several times, a metal mold with a cutting blade, use of a base ring with a large number of holes, and a metal mold with positioning means are then added. With these improvements, a highly accurate cylindrical ring with beads can be produced at low cost and with high productivity.

10 Claims, 23 Drawing Sheets

U.S. PATENT DOCUMENTS

| | | | | | |
|---|---|---|---|---|---|
| 3,501,828 | A | * | 3/1970 | Schultz | 29/437 |
| 3,581,456 | A | * | 6/1971 | Gere | 72/56 |
| 3,590,464 | A | * | 7/1971 | Wildi et al. | 29/419.2 |
| 4,702,543 | A | * | 10/1987 | Hager | 29/419.2 |
| 4,878,434 | A | * | 11/1989 | Sommet | 29/419.2 |
| 5,353,617 | A | * | 10/1994 | Cherian et al. | 72/56 |
| 5,619,878 | A | * | 4/1997 | Grosjean et al. | 72/56 |
| 5,730,016 | A | * | 3/1998 | Zittel | 72/56 |
| 5,813,264 | A | * | 9/1998 | Steingroever | 72/56 |
| 6,065,317 | A | * | 5/2000 | Steingroever | 72/56 |
| 6,751,994 | B2 | * | 6/2004 | Horton et al. | 72/55 |
| 6,990,840 | B2 | * | 1/2006 | Park | 72/56 |

FOREIGN PATENT DOCUMENTS

| | | |
|---|---|---|
| FR | 2 320 148 | 3/1977 |
| FR | 2488163 | 2/1982 |
| FR | 2 570 303 | 3/1986 |
| JP | 45-20599 | 8/1970 |
| JP | 58-4601 | 1/1983 |
| JP | 59-64125 | 4/1984 |
| JP | 62-277215 | 12/1987 |
| JP | 4-197524 | 7/1992 |
| JP | 6-63251 | 9/1994 |
| JP | 6-312226 | 11/1994 |
| JP | 8-10864 | 1/1996 |
| JP | 8-24969 | 1/1996 |
| JP | 8-118903 | 5/1996 |
| JP | 9-166111 | 6/1997 |
| JP | 10-58056 | 3/1998 |
| JP | 10-297226 | 11/1998 |
| JP | 2000-511467 | 9/2000 |
| JP | 2001-310602 | 11/2001 |
| JP | 2002-113626 | 4/2002 |
| WO | 97/45216 | 12/1997 |
| WO | WO 98/30354 | 7/1998 |

* cited by examiner 21
22
23
24
25
25a
25b
26
27
28
29
30
31
32
33
34
35
36
37
38
E

PROCESS FOR PRODUCING TUBULAR RING WITH BEADS AND DIE FOR USE THEREIN

TECHNICAL FIELD

The present invention relates to methods for manufacturing cylindrical rings with beads available to, for example, reinforced rings for run-flat tires, and relates to metal molds used for the methods.

BACKGROUND ART

Electromagnetic forming is a method in which a momentary large current is applied to a coil to generate a strong magnetic field such that an object (conductor) disposed in the magnetic field is molded by an interaction between an eddy current generated at the object and the magnetic field. The electromagnetic forming is a known technique disclosed in, for example, Japanese Unexamined Patent Application Publication Nos. 6-312226, 9-166111, 58-4601, and the like. The momentary large current is a current with a value of, for example, 10 kA or more.

Japanese Unexamined Patent Application Publication No. 6-312226 discloses an application of this electromagnetic forming to processing of a cylindrical member (hollow workpiece). According to the description, a coil for electromagnetic forming is inserted in the hollow workpiece of an extruded aluminum material, and molds for forming an expanded-tube shape are disposed adjacent to the outer circumference of the hollow workpiece E having a length corresponding to the coil. By applying a momentary large current to the coil in this arrangement, the outer circumference of the hollow workpiece is pressed toward the molds, and thus the outer circumference is molded into a shape corresponding to the molds. In this manner, a hollow component of which the cross-section is changed in the longitudinal direction is produced.

However, when the above-described method was simply applied for manufacture of a cylindrical ring with beads, a dimensional accuracy of products was insufficient, and the productivity could not be increased either. In order to put the method for manufacturing the cylindrical ring with the beads by electromagnetic forming to practical use, various additional schemes have been required.

The present invention is produced so as to solve the problems of the known method for manufacturing the cylindrical ring with the beads. It is an object of the present invention to produce highly accurate cylindrical rings with beads at low cost and with high productivity.

DISCLOSURE OF INVENTION

Methods for manufacturing a cylindrical ring with beads according to the present invention are based on the steps of disposing a metal mold adjacent to the outer circumference or the inner circumference of a closed metallic base ring, the metal mold having a molding face that faces the base ring and having grooves for forming the beads on the molding face along the circumferential direction; disposing a coil for electromagnetic forming at the opposite side of the metal mold such that the base ring is interposed therebetween; applying a momentary large current to the coil in this arrangement; and deforming the base ring by pressing the base ring toward the molding face of the metal mold such that the base ring is molded into a shape corresponding to the molding face by electromagnetic forming, and improvements are added on these.

First, manufacture of the cylindrical ring with the beads by electromagnetic forming will now be described, the present invention depending on the manufacture.

In the present invention, the beads mean ribs protruding in the direction of the external diameter of the cylindrical ring. The cylindrical ring with the beads according to the present invention includes, for example, a reinforced ring for a run-flat tire.

The above-described basic methods include the following two variations: That is to say, a method including the steps of disposing a metal mold adjacent to the outer circumference of a closed metallic base ring, the metal mold having a molding face in the inner circumference and having grooves for forming the beads on the molding face along the circumferential direction; disposing a coil for electromagnetic forming adjacent to the inner circumference of the base ring; applying a momentary large current to the coil in this arrangement; and expanding the diameter of the base ring by pressing the base ring toward the molding face of the metal mold such that the base ring is molded into a shape corresponding to the molding face by electromagnetic forming (so-called flaring processing), and a method including the steps of disposing a metal mold adjacent to the inner circumference of a closed metallic base ring, the metal mold having a molding face in the outer circumference and having ribs for forming the beads on the molding face along the circumferential direction; disposing a coil for electromagnetic forming adjacent to the outer circumference of the base ring; applying a momentary large current to the coil in this arrangement; and reducing the diameter of the base ring by pressing the base ring toward the molding face of the metal mold such that the base ring is molded into a shape corresponding to the molding face by electromagnetic forming (so-called nosing processing).

Metal molds used for electromagnetic forming include the followings: A metal mold having the ring-shaped molding face in the inner circumference and having the grooves for forming the beads on the molding face along the circumferential direction, and a metal mold having the ring-shaped molding face in the outer circumference and having the ribs for forming the beads on the molding face along the circumferential direction and grooves at both sides of the ribs.

Desirable materials for the base ring include copper, copper alloys, aluminum, and aluminum alloys that have high electrical conductivity. Moreover, in terms of the quality of these materials, annealed materials (type O defined by JIS H0001 for aluminum or aluminum alloys) and hot-worked materials (type F defined by JIS H0001 for the same) are desirable. Both of these materials have high electrical conductivity. Furthermore, the hot-worked materials are available at lower cost. In general, aluminum alloys have high electrical conductivity and relatively high strength. In particular, aluminum alloys of JIS 6000 series, especially, type 6063, type 6061, and the like are desirable. Among aluminum alloys of JIS 5000 series, type 5052 and the like are especially desirable.

As a base ring used for electromagnetic forming, a rolled or extruded plate roll-bended into a ring and connected at the ends, or an extruded cylindrical material cut to a predetermined length (length in the axial direction of extrusion) is available.

The thickness of the extruded plate can be arbitrarily set. Accordingly, the thickness of the cylindrical ring after electromagnetic forming can be made uniform by thickening the plate at positions to be thinned after flaring or nosing by electromagnetic forming (the positions of the beads and the vicinity in flaring, and the positions of the grooves at both sides of the beads and the vicinity in nosing) in advance.

Furthermore, a rolled or extruded plate spirally roll-bended into a tube and connected at the joints is also available to the cylindrical ring. In this case, a long spiral tube may be produced and cut to a required length as the cylindrical ring.

When the cylindrical ring is formed by welding, butt welding having no overlapped portion is desirable. In the case of lap welding, a minute gap between the overlapped portions is unavoidable, and thus a spark may be generated at the gap during electromagnetic forming to prevent normal electromagnetic forming.

Available welding methods include resistance welding, metal inert gas (MIG) welding, laser welding, friction stir welding (FSW), and the like. Although a variety of profiles can be employed for a groove of the butt joint, a profile having a uniform thickness over the circumference is desirable, and a profile having a thickness thinned after connecting at the connecting portion is especially undesirable. On the contrary, an extra reinforcement of a weld must be removed. Accordingly, laser welding having a small reinforcement of a weld is preferable.

During electromagnetic forming, loads are repeatedly applied to a workpiece in a very short time. Thus, the workpiece shaped by electromagnetic forming has excellent shape-fixability (small springback), and a highly accurate cylindrical ring with beads can be produced so as to achieve accurate circularity. In particular, when the ring is molded by expanding the diameter in the radial direction, higher circularity can be achieved compared with that of the ring molded by reducing the diameter. Furthermore, work hardening through the electromagnetic forming is more remarkable compared with the known method. Accordingly, the beads (in particular, top portions of the beads) are strengthened by the work hardening.

Applications of the cylindrical ring include a reinforced ring for a run-flat tire. The reinforced ring requires high circularity. Since treads (portions that are in contact with the ground through tires) correspond to the top portions of the beads, the cylindrical ring having high circularity and strengthened beads (i.e. flared by electromagnetic forming) is especially suitable for the reinforced ring. A plate of aluminum or an aluminum alloy having a thickness of 3 mm or less is used as the reinforced ring.

When an extruded cylindrical material is used for producing the cylindrical ring, the cylindrical ring does not have any connecting portions. However, the cylindrical ring normally has at least one connecting portion, desirably a connecting portion by butt welding. This connecting portion is formed parallel to or inclined to the axial direction.

Next, features of the methods for manufacturing the cylindrical ring with the beads according to the present invention will now be described.

The molding face of the metal mold is symmetrical with respect to a plane vertical to the axial direction at the central position of the axial direction. Furthermore, the central position of the base ring in the axial direction desirably corresponds to that of the molding face of the metal mold in the axial direction. The length of the base ring in the axial direction is reduced when the base ring is molded by flaring or nosing by electromagnetic forming (since portions of the ring are attracted into the grooves on the molding face). However, the possibility of more uniform reduction and molding of the base ring is increased with the molding face described as above. The axial direction of the molding face of the metal mold corresponds to that of the base ring.

Preferably, the grooves on the metal mold according to the present invention have holes communicating with the exterior of the grooves. That is to say, vents or slits for degassing are formed in the grooves. Since molding is completed in a very short time of approximately a few hundred microseconds in electromagnetic forming, air left in gaps between the molding face and the base ring cannot escape during molding. Therefore, the air is trapped and highly pressurized in the gaps between the molding face and the portions pressed thereto at the grooves. The highly pressurized air prevents the portions from being pressed toward the molding face at the grooves, and causes problems such as hollows created on the surfaces of the beads after electromagnetic forming. This problem can be solved by forming vents or slits for degassing in the grooves.

Preferably, the metal mold according to the present invention is formed of a plurality of pieces separable in the circumferential direction. With this structure, the cylindrical ring can easily be removed from the metal mold after molding.

Preferably, when the metal mold having the ring-shaped molding face in the inner circumference and having the grooves for forming the beads on the molding face along the circumferential direction is used for electromagnetic forming, the metal mold according to the present invention is formed of a plurality of mold segments separable in the axial direction at the grooves, and a gap is provided between two adjacent mold segments in the axial direction. When the metal mold having the ring-shaped molding face in the outer circumference and having the ribs for forming the beads on the molding face along the circumferential direction and the grooves at both sides of the ribs is used for electromagnetic forming, the metal mold according to the present invention is formed of a plurality of mold segments separable in the axial direction at the grooves, and a gap is provided between two adjacent mold segments in the axial direction. With these structures, slits are formed at the grooves over the entire circumference of the metal mold, and thus the problem of dents is completely solved. The axial direction herein means a direction of an axis of the molding face of the metal mold (or the cylindrical ring).

Preferably, when a dimensional accuracy is insufficient after molding the cylindrical ring by electromagnetic forming (flaring or nosing), the cylindrical ring is corrected by, for example, roll-correcting such that the dimensional accuracy of the beads and the like is improved. That is to say, an inner roll and an outer roll of which outer dimensions are finished with a required accuracy are prepared, and the cylindrical ring molded into the shape corresponding to the molding face by electromagnetic forming is corrected by rotating the rolls while interposing the cylindrical ring between the inner roll and the outer roll.

Preferably, the step of applying the momentary large current to the coil is repeated a plurality number of times such that the dimensional accuracy is improved. In this case, electromagnetic forming (nosing) may be performed after electromagnetic forming (flaring), or the forming operations may be inversely preformed. Alternatively, the same forming operation of flaring or nosing may be repeated a plurality number of times. In all cases, the second and subsequent electromagnetic forming operations are regarded as correcting operations.

Preferably, the metal mold has a circular cutting blade between each of molding faces corresponding to the cylindrical rings, and the cutting blade can cut the base ring when the base ring is pressed toward the molding faces of the metal mold. As a result, a plurality of cylindrical rings with beads can be produced at one time by electromagnetic forming (flaring or nosing). In this case, the metal mold must have the plurality of molding faces each corresponding to a cylindrical ring in the axial direction, and the coil for the electromagnetic forming also requires a length corresponding to the molding faces in the axial direction. In this case, the plurality of cylindrical rings can be separated at the same time as the electromagnetic forming, and thus the productivity is improved.

Preferably, when the plurality of cylindrical rings are produced at one time but are not separated in the metal mold, rolls with cutting blades can be used to separate the cylindrical rings at the same time as roll-correcting in the same manner as the roll-correcting.

Preferably, the base ring according to the present invention has a large number of holes in the circumferential wall. These holes are preferably arranged in the circumference wall in a regular manner. The cylindrical ring can be reduced in weight by forming the plurality of holes in the circumference wall. The cylindrical ring can be effectively reduced in weight when the holes are formed in the approximately overall circumferential wall of the base ring in a regular manner. Such a base ring includes, for example, a ring produced by roll-bending a perforated metal and by connecting the ends, and a ring produced by spirally winding a perforated metal and by connecting the joints by welding.

In electromagnetic forming, the base ring is pressed into the grooves of the molding face of the metal mold, and thus the base ring transfers in the axial direction along the molding face of the metal mold. At this time, strong frictional resistance occurs between the molding face of the metal mold and the base ring. The formation of the plurality of holes in the base ring can reduce the contact area between the metal mold and the base ring that come into contact with each other in electromagnetic forming, and can reduce the frictional resistance therebetween. As a result, the base ring can smoothly enter the interior of the grooves from the exterior of the grooves of the molding face of the metal mold, resulting in more accurate molding. In particular, the large number of holes are effective when formed in the circumferential wall of the base ring along the circumferential direction at positions where portions of the base ring enter the interior of the grooves from the exterior of the grooves of the molding face of the metal mold in electromagnetic forming. In general, these positions are at both end portions of the base ring in the axial direction.

Preferably, positioning holes during electromagnetic forming are formed in the base ring. For the cylindrical ring molded by electromagnetic forming (flaring), a large number of projections are formed in the molding face of the metal mold along the circumferential direction at positions where the internal diameter of the molding face is the smallest, a large number of holes are formed in the base ring along the circumferential direction at positions corresponding to the projections, and the projections are fitted into the holes when the metal mold is disposed adjacent to the outer circumference of the base ring. In this case, the projections are desirably formed between two adjacent grooves on the molding face at the central position of the molding face of the metal mold in the axial direction, and also, the holes are desirably formed at the central position of the base ring in the axial direction.

For the cylindrical ring molded by electromagnetic forming (nosing), a large number of projections are formed in the molding face of the metal mold along the circumferential direction at positions where the external diameter of the molding face is the largest, a large number of holes are formed in the cylindrical ring along the circumferential direction at positions corresponding to the projections, and the projections are fitted into the holes when the metal mold is disposed adjacent to the inner circumference of the cylindrical ring. In this case, the projections are desirably formed on the ribs on the molding face at the central position of the molding face of the metal mold in the axial direction, and also, the holes are preferably formed at the central position of the base ring in the axial direction.

With these structures, the base ring is accurately positioned in the metal mold, and the base ring fixed by these positioning holes also does not transfer in the axial direction during electromagnetic forming.

Preferably, the base ring is in contact with the molding face of the metal mold at the central position of the molding face of the metal mold in the axial direction before electromagnetic forming. That is to say, in flaring, the internal diameter at the central position of the molding face of the metal mold in the axial direction is the smallest, and the outer circumference of the base ring is in contact with the molding face of the metal mold at the corresponding position. With this structure, the base ring is positioned at the corresponding position at molding, and thus more uniform molding can be performed. On the contrary, in nosing, the external diameter at the central position of the molding face of the metal mold in the axial direction is the largest, and the inner circumference of the base ring is in contact with the molding face of the metal mold at the corresponding position. In both cases, the central position of the molding face of the metal mold in the axial direction desirably corresponds to that of the base ring in the axial direction.

Meanwhile, the holes formed in the base ring can be used to connect the molded cylindrical ring with other members. For example, in a reinforced ring for a run-flat tire, resin is attached to the reinforced ring at both end portions in the axial direction. At this time, the resin flows into the holes such that the connection between the reinforced ring and the resin becomes more secure.

In addition, the cylindrical ring molded by electromagnetic forming can be cut off in the circumferential direction, if necessary. The cutting direction is preferably parallel to or inclined to the axial direction of the cylindrical ring, for example. Two of such cylindrical rings can be linked together through respective cut-off portions (splits), and thus only a small space is required for storage or transportation. Furthermore, the cut-off portion of the cylindrical ring can be reconnected so as to close the ring again. For the reconnection by welding, butt welding is desirable, and in particular, laser welding having a small reinforcement of a weld is preferable.

BEST MODE FOR CARRYING OUT THE INVENTION

Methods for manufacturing a cylindrical ring with beads according to the present invention and the resultant cylindrical ring with the beads will now be described in detail with reference to FIGS. 1 to 25.

Figure 1A:
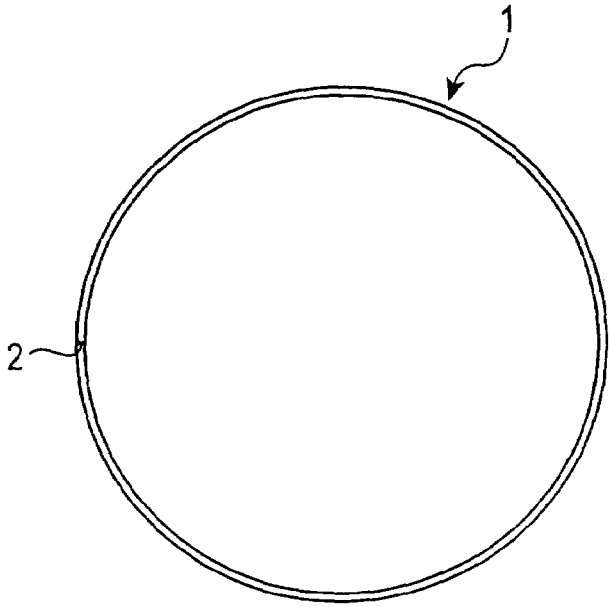
FIGS. 1(*a*) and 1(*b*) are a side view and a front view, respectively, of a base ring before electromagnetic forming.
Figure 1B:
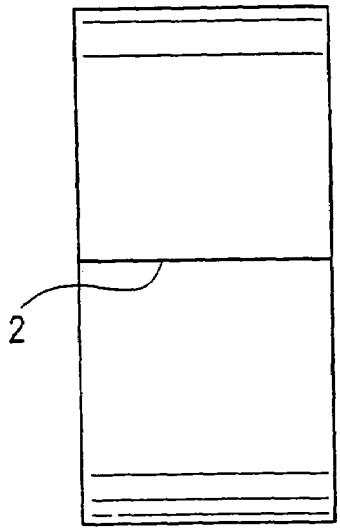

A base ring 1 shown in FIG. 1 is formed by roll-bending a plate of, for example, an aluminum alloy and by butt welding the ends. A reference numeral 2 denotes a connecting portion formed by the butt welding.

Figure 3A:
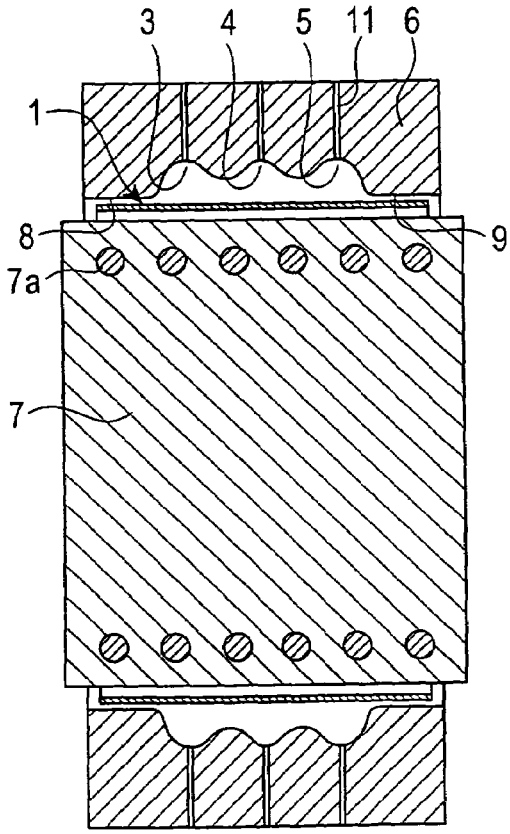
FIGS. 3(*a*) and 3(*b*) are cross-sectional views before and after molding, respectively, illustrating a method for manufacturing a cylindrical ring with beads by electromagnetic forming.
Figure 3B:
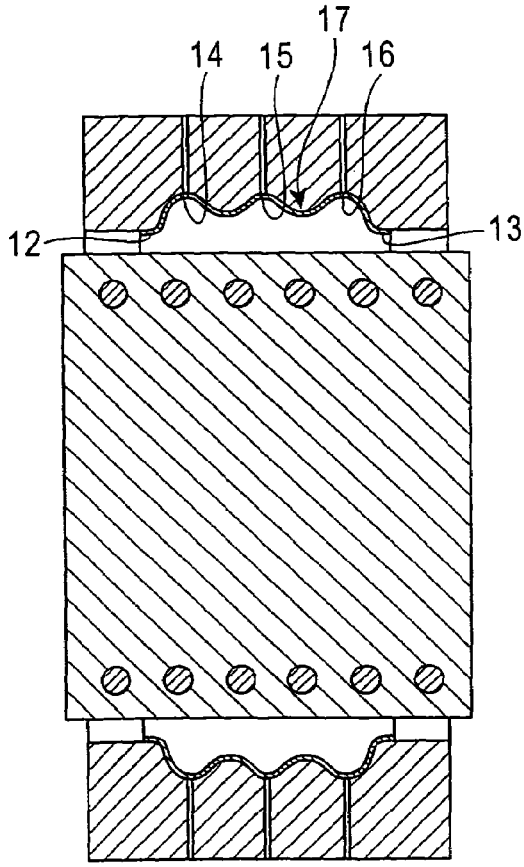

FIG. 3 illustrates a method for molding the base ring 1 by electromagnetic forming (flaring). In FIG. 3(*a*), a metal mold 6 is disposed adjacent to the outer circumference of the base ring 1, and has a molding face in the inner circumference and grooves 3 to 5 for forming beads on the molding face along the circumferential direction. A coil component 7 for electromagnetic forming is disposed adjacent to the inner circumference of the base ring 1. The molding face of the metal mold 6 is substantially rotationally symmetrical with respect to the central axis (although the molding face is not rotationally symmetrical with respect to the central axis in the strict sense of the word due to, for example, vents 11 (described below), the molding face can be substantially regarded to be rotationally symmetrical with respect to the central axis in terms of the functionality), and is substantially symmetrical with respect to a plane vertical to the axial direction at the central position of the axial direction. Moreover, the central position of the molding face of the metal mold 6 in the axial direction corresponds to that of the base ring 1 in the axial direction. Small gaps are provided between the outer circumference of the base ring 1 and the inner circumference of the metal mold 6, and between the inner circumference of the base ring 1 and the coil component 7.

The metal mold 6 is desirably composed of a metal with low electrical conductivity such as stainless steel. Materials other than metals, for example, structural materials having no electrical conductivity such as fiber-reinforced plastic or bakelite can also be employed. The grooves 3 to 5 formed on the molding face (inner circumference) of the metal mold 6 extend in the radial direction, and are undulated abreast with each other. Ends of the grooves 3 and 5 are connected to parallel end portions 8 and 9 of the molding face, respectively. Moreover, a large number of vents 11 for degassing are formed in bottom portions of the grooves 3 to 5 along the circumferential direction. The vents 11 may be long slits formed along the circumferential direction. The coil component 7 is formed of a molding coil 7*a* embedded in an electrical insulator.

When a momentary large current is applied to the coil component 7 in the state shown in FIG. 3(*a*), a force by magnetic repulsion is generated at the base ring 1. The diameter of the base ring 1 is then expanded, and the base ring 1 is pressed toward the molding face of the metal mold 6 at that moment. Thus, as shown in FIG. 3(*b*), the base ring 1 is molded into a shape along the molding face so as to be a cylindrical ring 17 with beads. The cylindrical ring 17 includes short parallel portions 12 and 13 at both ends in the axial direction and three beads 14 to 16 (that are undulated abreast with each other) convexed in the radial direction along the circumferential direction between the parallel portions 12 and 13 (See FIG. 2 for a detailed shape). The cylindrical ring 17 is substantially rotationally symmetrical with respect to the central axis, and is substantially symmetrical with respect to a plane vertical to the axial direction at the central position of the axial direction. The base ring 1 is attracted to the grooves 3 to 5 by the electromagnetic forming, and as a result, the width of the cylindrical ring 17 in the axial direction is made smaller than the width of the base ring 1 in the axial direction.

The metal mold 6 is formed of a plurality of pieces separable in the circumferential direction (See separable pieces

25*a* and 25*b* of a separable mold segment 25) such that the cylindrical ring 17 can be removed from the metal mold 6 after molding.

Figures 4A, 4B, 4C:
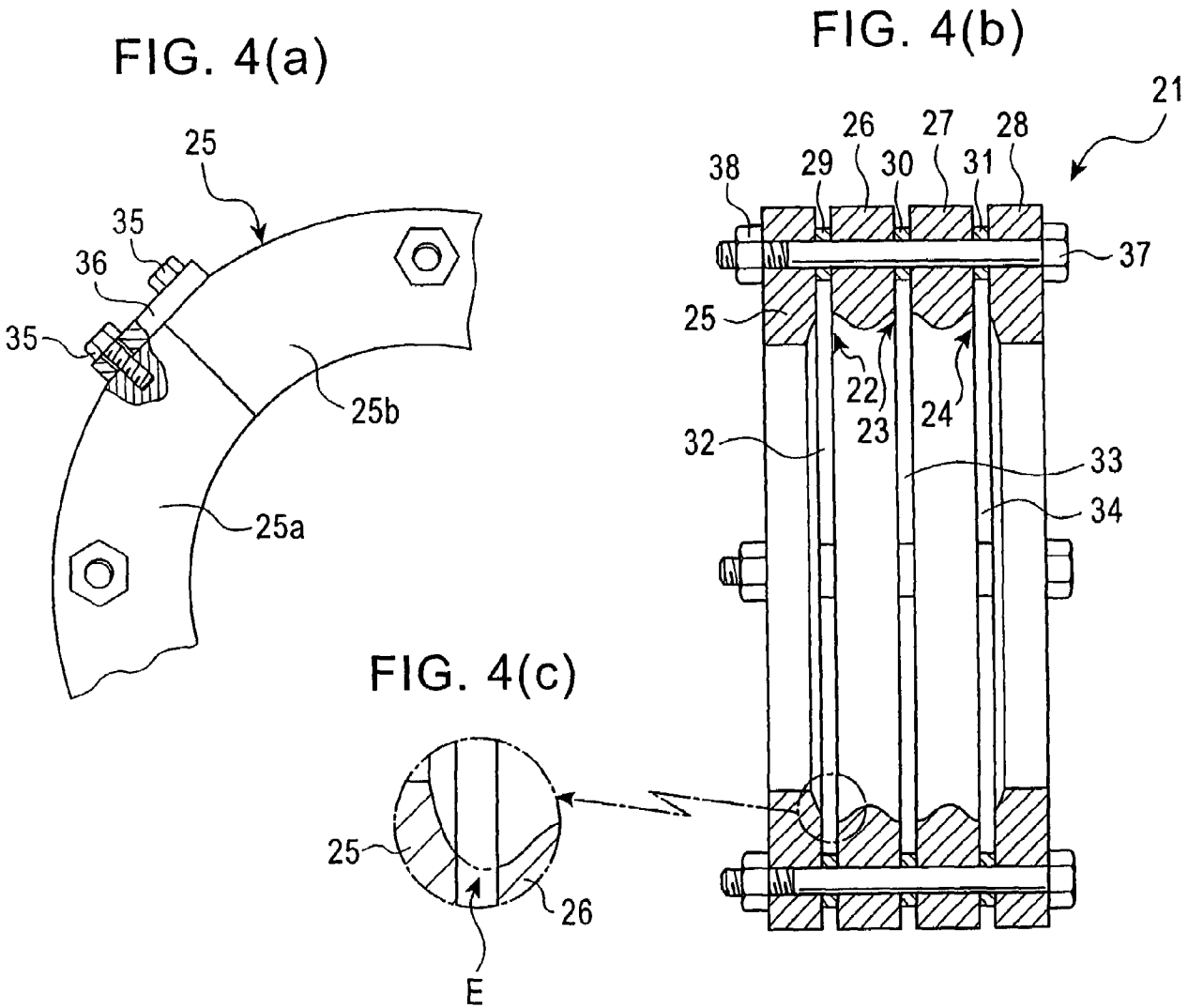
FIGS. 4(*a*), 4(*b*), and 4(*c*) are a side view, a cross-sectional view, and a partly enlarged view of the cross-sectional view, respectively, illustrating an exemplary structure of a metal mold for electromagnetic forming.

FIG. 4 illustrates an exemplary structure of a metal mold including a plurality of mold segments separable in the axial direction. This metal mold 21 has a molding face in the inner circumference, and grooves 22 to 24 for forming beads on the molding face along the circumferential direction. The metal mold 21 is formed of a plurality of ring-shaped separable mold segments 25 to 28 separable in the axial direction at the grooves 22 to 24. The separable mold segments 25 to 28 are disposed with ring-shaped spacers 29 to 31 interposed therebetween. As a result, gaps 32 to 34 are provided between two adjacent separable mold segments 25 to 28.

Furthermore, the separable mold segment 25 (the same applies to the separable mold segments 26 to 28) is formed of a plurality of separable pieces 25*a* and 25*b* (in some cases, two or more separable pieces) separable in the circumferential direction and linked by bolts 35 and catching pieces 36.

In FIG. 4, a reference numeral 37 denotes a bolt for fixing the separable mold segments 25 to 28, and a reference numeral 38 denotes a nut.

In this metal mold 21, the separable mold segments 25 to 28 each has a curved molding face being part of the grooves 22 to 24, and the molding faces and the gaps 32 to 34 disposed in the middle portions thereof (the bottom portions of the grooves 22 to 24) form the grooves 22 to 24. In other words, the groove 22 is formed of the curved molding faces of two adjacent separable mold segments 25 and 26 and the gap 32 in the middle portion, the groove 23 is formed of the curved molding faces of two adjacent separable mold segments 26 and 27 and the gap 33 in the middle portion, and the groove 24 is formed of the curved molding faces of two adjacent separable mold segments 27 and 28 and the gap 34 in the middle portion. The molding faces of the metal mold 21 are substantially rotationally symmetrical with respect to the central axis, and are substantially symmetrical with respect to a plane vertical to the axial direction at the central position of the axial direction. The gaps 32 to 34 are formed in the respective grooves 22 to 24 over the entire circumference, and function as slits for degassing during electromagnetic forming.

A base ring is disposed adjacent to the inner circumference of the metal mold 21 such that the central position of the molding face of the metal mold 21 in the axial direction corresponds to the central position of the base ring in the axial direction. In addition, a coil component for electromagnetic forming is disposed adjacent to the inner circumference of the base ring. When electromagnetic forming is performed with this arrangement, the diameter of the base ring is expanded, and the base ring is pressed toward the molding face of the metal mold 21 (the separable mold segments 25 to 28) at that moment as in the case shown in FIGS. 1 and 3. Thus, the base ring is molded into a shape along the molding face, whereas the base ring is freely deformed at the gaps 32 to 34 (the bottom portions of the grooves 22 to 24) in response to loads applied to the base ring. In short, top portions of beads of a cylindrical ring are formed in these gaps 32 to 34 (the bottom portions of the grooves 22 to 24). By appropriately setting the widths of the gaps 32 to 34, degassing can be successfully performed, and the ring can be deformed at these gaps 32 to 34 into a shape substantially along curved lines (See a virtual line E shown in FIG. 4(*c*)) formed by interpolating the molding faces of two adjacent separable mold segments interposed by the gaps 32 to 34. The resultant cylindrical ring with the beads is substantially rotationally symmetrical with respect to the central axis, and is substantially symmetrical with respect to a plane vertical to the axial direction at the central position of the axial direction.

Figure 5A:
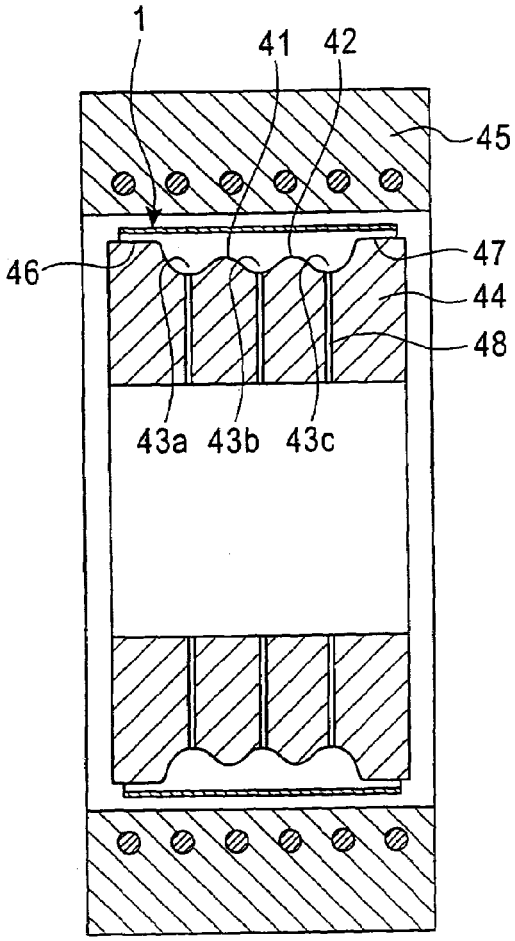
FIGS. 5(*a*) and 5(*b*) are cross-sectional views before and after molding, respectively, illustrating a method for manufacturing a cylindrical ring with beads by electromagnetic forming.
Figure 5B:
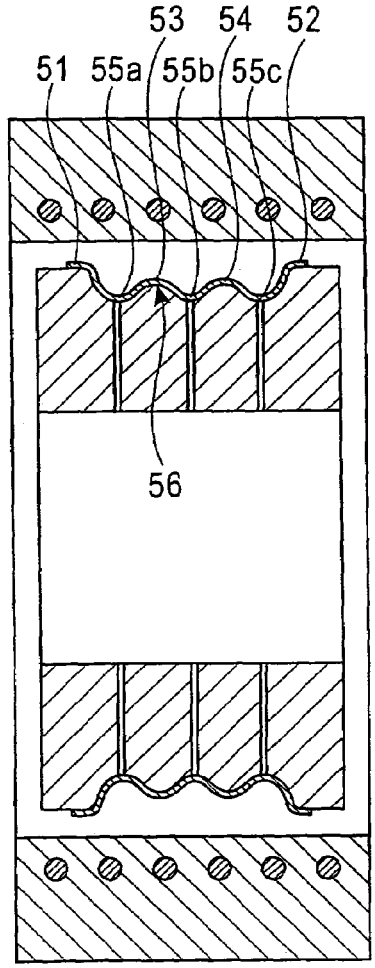

FIG. 5 illustrates a method for molding the base ring 1 by electromagnetic forming (nosing). In FIG. 5(*a*), a metal mold 44 is disposed adjacent to the inner circumference of the base ring 1; and has a molding face in the outer circumference, ribs 41 and 42 for forming beads on the molding face along the circumferential direction, and grooves 43*a* to 43*c* at both sides of the ribs. A coil component 45 for electromagnetic forming is disposed adjacent to the outer circumference of the base ring 1. Small gaps are provided between the inner circumference of the base ring 1 and the outer circumference of the metal mold 44, and between the outer circumference of the base ring 1 and the coil component 45.

The ribs 41 and 42 formed on the molding face (outer circumference) of the metal mold 44 protrude in the radial direction and the grooves 43*a* to 43*c* extend in the radial direction. These ribs 41 and 42 and the grooves 43*a* to 43*c* are undulated abreast with each other, and ends of the grooves 43*a* and 43*c* are connected to parallel end portions 46 and 47 of the molding face, respectively. The molding face of the metal mold 44 is substantially rotationally symmetrical with respect to the central axis, and is substantially symmetrical with respect to a plane vertical to the axial direction at the central position of the axial direction. Moreover, the central position of the molding face of the metal mold 44 in the axial direction corresponds to that of the base ring 1 in the axial direction. As in the case shown in FIG. 3, vents or slits 48 for degassing are formed in bottom portions of the grooves 43*a* to 43*c*.

When a momentary large current is applied to the coil component 45 in the state shown in FIG. 5(*a*), a force by magnetic repulsion is generated at the base ring 1. The diameter of the base ring 1 is then reduced, and the base ring 1 is pressed toward the molding face of the metal mold 44 at that moment. Thus, as shown in FIG. 5(*b*), the base ring 1 is molded into a shape along the molding face so as to be a cylindrical ring 56 with beads. The cylindrical ring 56 includes short parallel portions 51 and 52 at both ends and two beads 53 and 54 (grooves 55*a* to 55*c* are formed at both sides of the respective beads, and are undulated abreast with the beads 53 and 54) convexed in the radial direction along the circumferential direction between the parallel portions 51 and 52. This cylindrical ring 56 is substantially rotationally symmetrical with respect to the central axis, and is substantially symmetrical with respect to a plane vertical to the axial direction at the central position of the axial direction. The base ring 1 is attracted to the grooves 43*a* to 43*c* by the electromagnetic forming, and as a result, the width of the cylindrical ring 56 in the axial direction is made smaller than the width of the base ring 1 in the axial direction.

The metal mold 44 is formed of a plurality of pieces separable in the circumferential direction such that the cylindrical ring 54 can be removed from the metal mold 44 after molding.

Figure 6A:
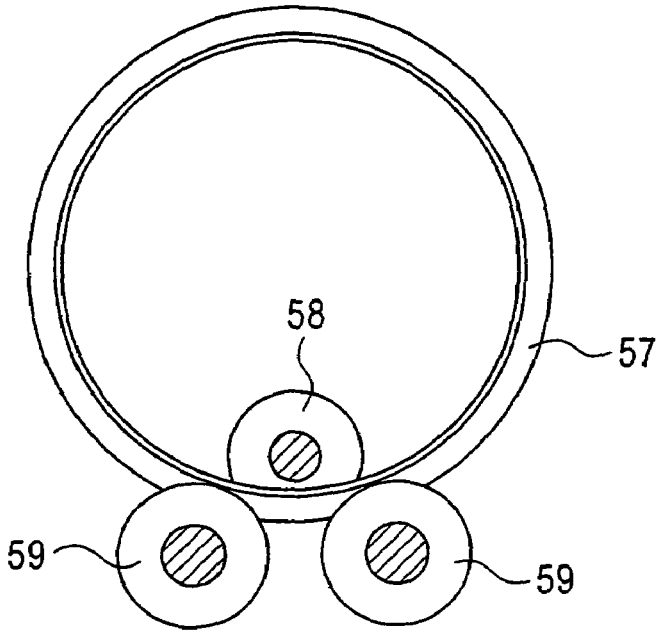
FIGS. 6(*a*) and 6(*b*) are a sectioned side view and a sectioned front view, respectively, illustrating a method for correcting a cylindrical ring with beads.
Figure 6B:
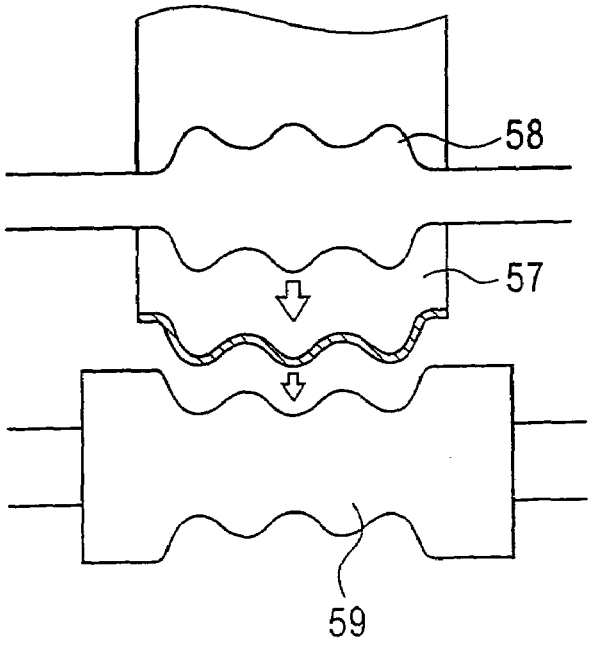

FIG. 6 illustrates a method for roll-correcting to improve dimensional accuracy of a cylindrical ring 57 with beads after electromagnetic forming (flaring or nosing). It may be performed, for example, when a dent is created on a bead due to insufficient degassing, or when the accuracy of a top portion of a bead that is freely deformed is low after electromagnetic forming using a type of the metal mold shown in FIG. 4.

The roll-correcting is performed by holding the cylindrical ring 57 between an inner roll 58 and outer rolls 59 of which outer dimensions are finished with a required accuracy, and by rotating the rolls while adjusting the shift of the inner roll 58.

Figure 7A:
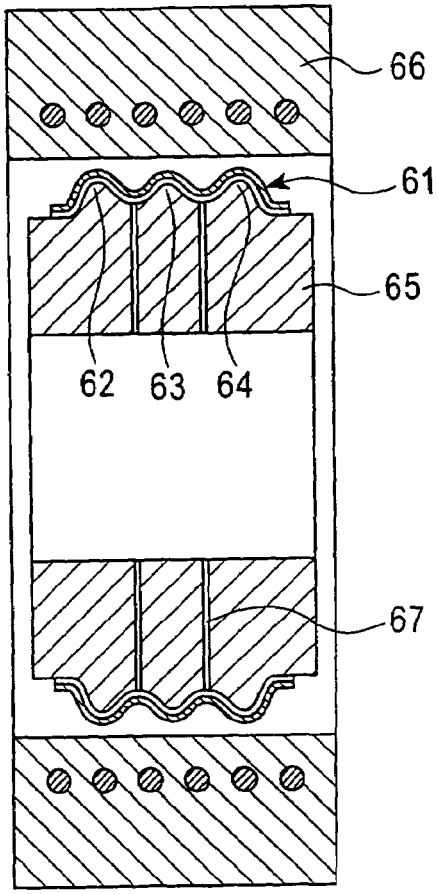
FIGS. 7(*a*) and 7(*b*) are cross-sectional views before and after correcting, respectively, illustrating the method for correcting the cylindrical ring.
Figure 7B:
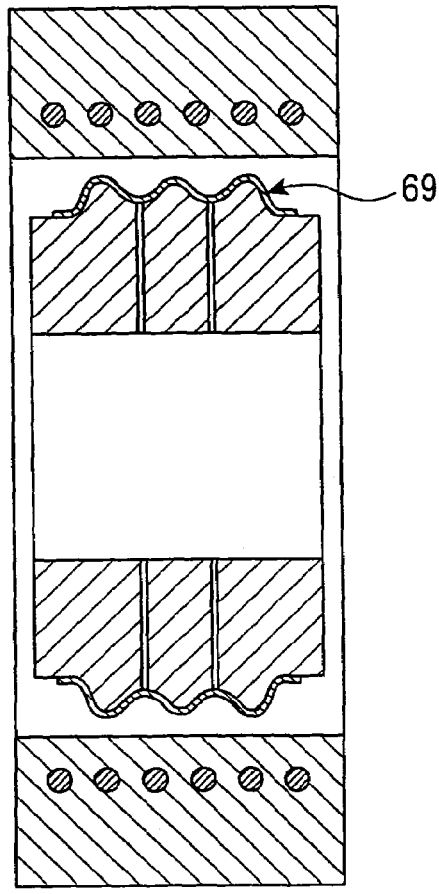

FIG. 7 illustrates a method for correcting by additional electromagnetic forming (nosing) to improve dimensional accuracy of a cylindrical ring 61 with beads molded by electromagnetic forming (flaring). It may be performed, for example, when a dent is created on a bead due to insufficient degassing, or when the accuracy of a top portion of a bead that is freely deformed is low after electromagnetic forming using a type of the metal mold shown in FIG. 4. In this case, the diameter of the cylindrical ring 61 is expanded slightly larger than that in the final shape.

As shown in FIG. 7(*a*), a metal mold 65 is disposed adjacent to the inner circumference of the cylindrical ring 61 that is molded by electromagnetic forming (flaring) in advance, and has a molding face corresponding to the final shape in the outer circumference and protrusions 62 to 64 for correcting on the molding face along the circumferential direction. A coil component 66 for electromagnetic forming is disposed adjacent to the outer circumference of the cylindrical ring 61. The molding face of the metal mold 65 is substantially rotationally symmetrical with respect to the central axis. A reference numeral 67 denotes a vent or a slit for degassing. Furthermore, the metal mold 65 is formed of a plurality of pieces separable in the circumferential direction as in the case described above.

As shown in FIG. 7(*b*), when a momentary large current is applied to the coil component 66 in the state, electromagnetic forming (nosing) is performed as in the case shown in FIG. 5. Thus, the cylindrical ring 61 is molded, i.e. corrected, into a shape along the molding face of the metal mold 65 so as to be a cylindrical ring 69 with beads having a high dimensional accuracy.

Figure 8C:
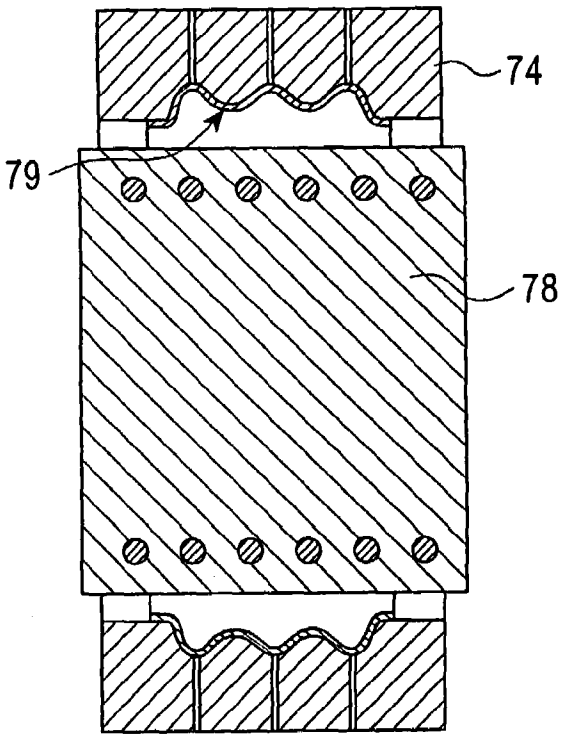
FIGS. 8(*a*), 8(*b*), and 8(*c*) are cross-sectional views before molding, after a first-step molding, and a second-step molding, respectively, illustrating a method for molding a cylindrical ring with beads with multiple steps.
Figure 8B:
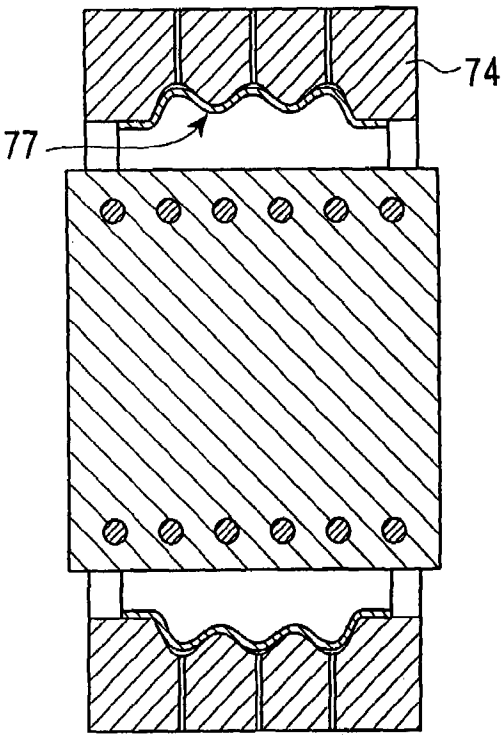
Figure 8A:
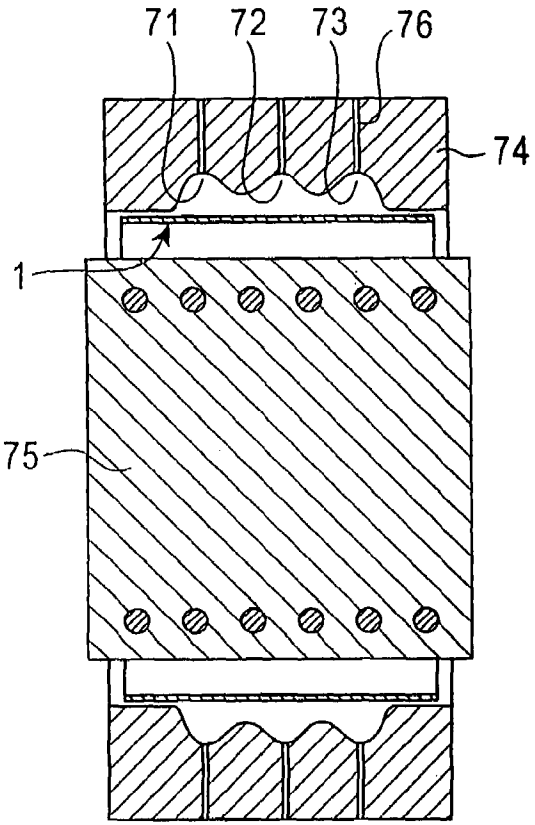

FIG. 8 illustrates a multi-step process for obtaining a cylindrical ring with beads having a high dimensional accuracy by repeating electromagnetic forming.

First, as shown in FIG. 8(*a*), a metal mold 74 is disposed adjacent to the outer circumference of the base ring 1, and has a molding face in the inner circumference and grooves 71 to 73 for forming beads on the molding face along the circumferential direction. A coil component 75 for electromagnetic forming is disposed adjacent to the inner circumference of the base ring 1. The molding face of the metal mold 74 is substantially rotationally symmetrical with respect to the central axis. A large number of vents or slits 76 for degassing are formed in bottom portions of the grooves 71 to 73. Moreover, the metal mold 74 is formed of a plurality of pieces separable in the circumferential direction.

When a momentary large current is applied to the coil component 75 in the state shown in FIG. 8(*a*), the diameter of the base ring 1 is expanded, and the base ring 1 is pressed toward the molding face of the metal mold 74 at that moment. However, the electrical energy applied to the coil component 75, i.e. the force by magnetic repulsion generated at the base ring 1, at this time is not set so large. Accordingly, as shown in FIG. 8(*b*), the base ring 1 is not molded into a shape sufficiently along the molding face (in particular, the grooves 71 to 73) of the metal mold 74. That is to say, the base ring 1 is attracted to the grooves 71 to 73 so as to be convexed, whereas gaps are formed between a molded cylindrical ring 77 with beads and the molding face (in particular, the grooves 71 to 73) of the metal mold 74. Therefore, even when air is shut in the gaps due to insufficient degassing, this does not lead to an extremely high pressure, and the problem of the dents is reduced.

Next, as shown in FIG. 8(*c*), electromagnetic forming is performed again, and the cylindrical ring 77 is molded into the shape along the molding face (in particular, the grooves 71 to 73) of the metal mold 74, i.e. the final shape this time. This molding can be regarded as a sort of correction.

In this embodiment, the force by magnetic repulsion is generated more effectively by using a coil component 78 for electromagnetic forming having a larger coil diameter. A cylindrical ring 79 with beads is formed into a shape along the molding face of the metal mold 74 after molding, and is in almost close contact with the molding face. Since the volume of the air possibly shut in the grooves 71 to 73 is small compared with the molding of the base ring 1 into the cylindrical ring 79 in one step, the pressure is not excessively increased even with insufficient degassing, and the problem of the dents is resolved.

In this embodiment, although two-step molding is performed by using the same metal mold 74, different metal molds (for preliminary molding and for finishing) may also be used. In that case, the base ring may be molded into a shape along the molding face of the metal mold for preliminary molding in the first molding step.

Figure 9:
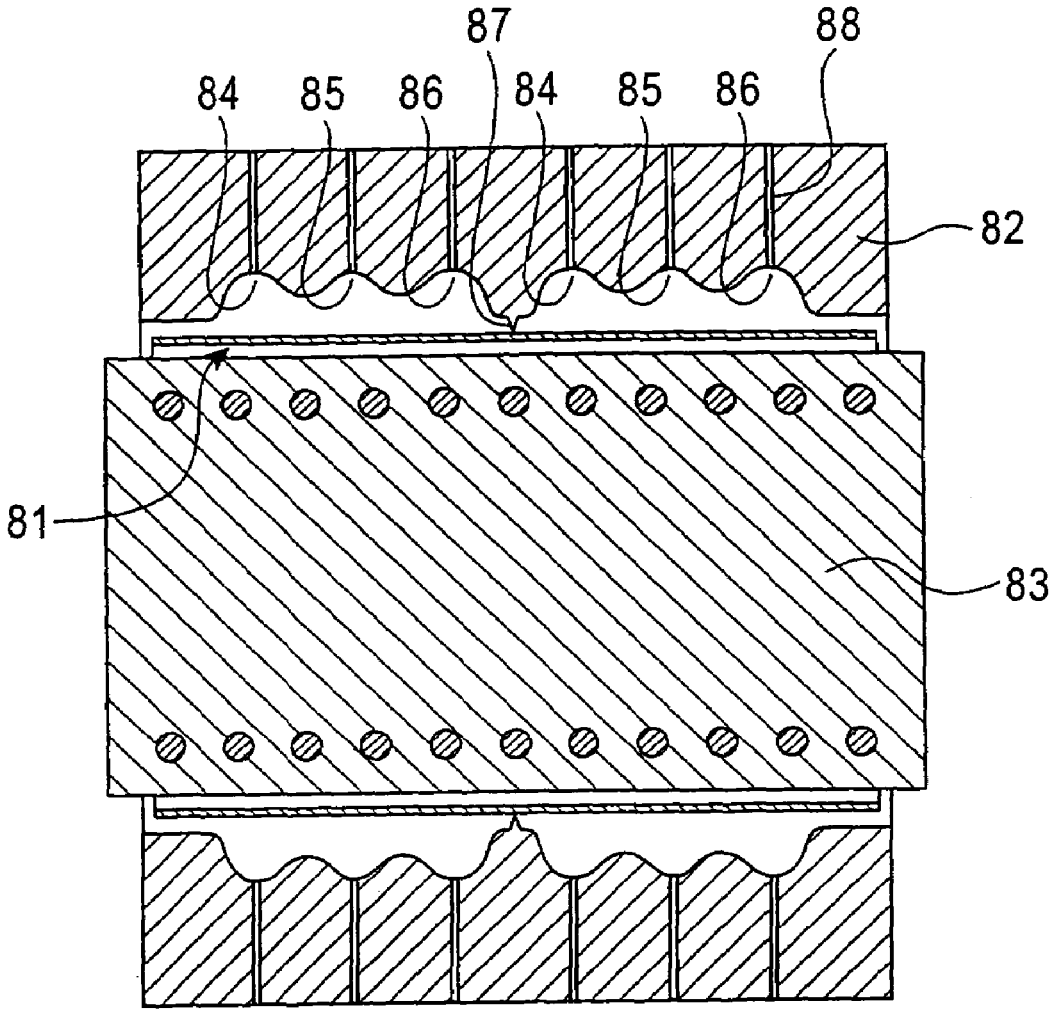
FIG. 9 is a cross-sectional view illustrating a method for manufacturing a plurality of cylindrical rings with beads at one time.

FIG. 9 illustrates a method for molding a plurality of (in this embodiment, two) cylindrical rings with beads in one step. A metal mold 82 is disposed adjacent to the outer circumference of a base ring 81 having a length corresponding to two rings, and has a molding face in the inner circumference. A coil component 83 for electromagnetic forming is disposed adjacent to the inner circumference of the base ring 81. Two sets of grooves 84 to 86 for forming beads are formed on the molding face of the metal mold 82 along the circumferential direction abreast in the axial direction. A circular cutting blade 87 is disposed inward in the intermediate position of the metal mold 82. A large number of vents or slits 88 for degassing are formed in bottom portions of the grooves 84 to 86 along the circumferential direction. Moreover, The metal mold 82 is formed of a plurality of pieces separable in the circumferential direction.

When a momentary large current is applied to the coil component 83 in the state shown in FIG. 9, a force by magnetic repulsion is generated at the base ring 81. The diameter of the base ring 1 is then expanded, and the base ring 1 is pressed toward the molding face of the metal mold 82 at that moment. Thus, the base ring 81 is molded into a shape along the molding face, and at the same time, is separated at the intermediate position by the cutting blade. As a result, two rings same as the cylindrical ring 17 shown in FIG. 3(*b*) can be produced at one time.

When there is no cutting blade 87 in the metal mold 82 shown in FIG. 9, the resultant cylinder with beads includes a plurality of cylindrical rings with beads linked together.

Figure 10A:
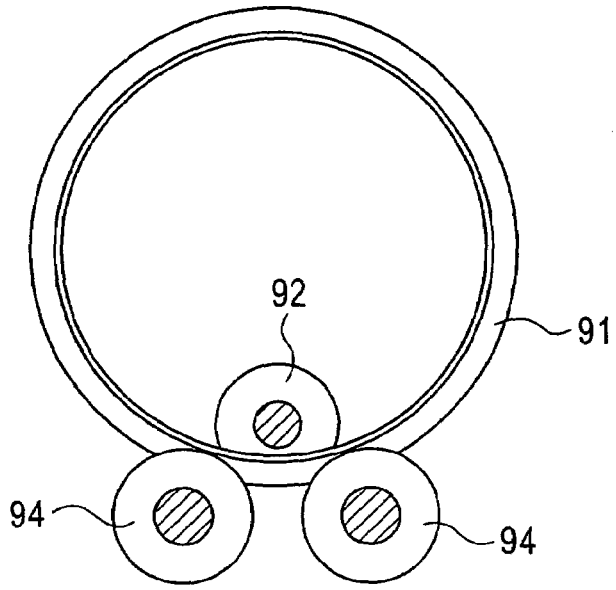
FIGS. 10(*a*) and 10(*b*) are a sectioned side view and a sectioned front view, respectively, illustrating a method for separating and correcting the connected cylindrical rings.
Figure 10B:
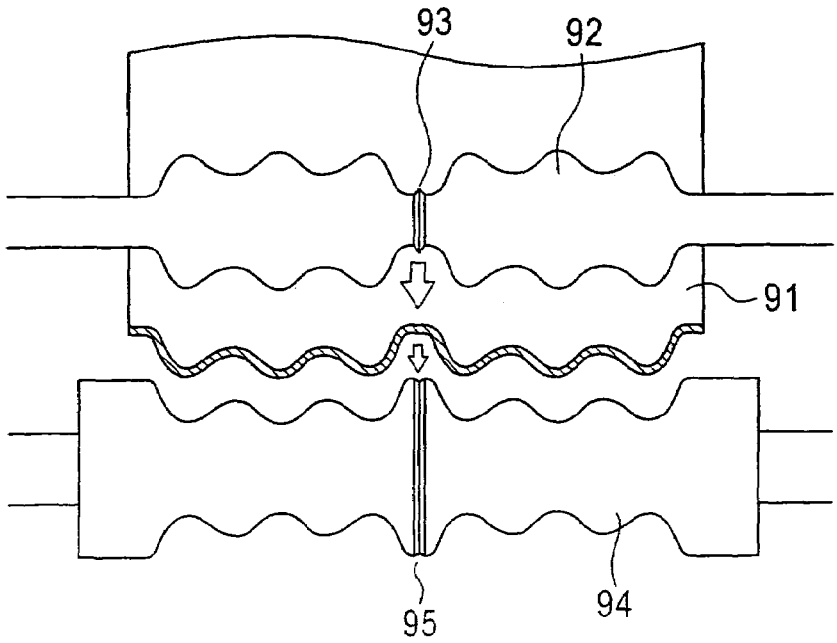

FIG. 10 illustrates a method for roll-correcting and cutting to improve dimensional accuracy of such a cylinder 91 with beads including a plurality of (two) cylindrical rings with beads linked together, and at the same time, to separate the cylinder 91 into a plurality of (two) individual cylindrical rings. The method for roll-correcting is basically the same as that shown in FIG. 6. However, in this case, a cutting blade 93 is formed in the intermediate position of an inner roll 92, and receiving blades 95 for the cutting blade 93 are formed in respective positions of outer rolls 94. The roll-correcting and cutting is performed by holding the cylinder 91 between the inner roll 93 and the outer rolls 94, and by rotating the rolls while the inner roll 93 is shifted.

Figure 11:
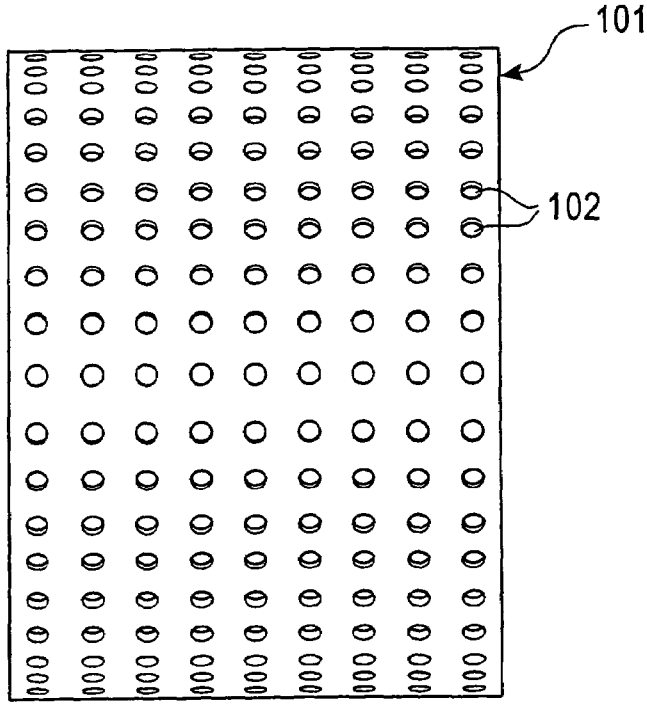
FIG. 11 is a front view of another base ring used for the present invention.

FIG. 11 illustrates a base ring 101 having a large number of holes 102 formed over the entire surface of the circumferential wall. This base ring 101 can be produced by roll-bending a rectangular metal plate (for example, a plate of an aluminum alloy) having the holes 102 regularly arranged in a grid, i.e. a perforated metal, and by connecting the ends by welding or the like.

When the base ring 101 is molded by electromagnetic forming using, for example, the metal mold 6 and the coil component 7 shown in FIG. 3, a lighter cylindrical ring with beads can be produced. Since the large number of holes 102 are formed over the entire surface of the base ring 101, the degassing vents or slits formed in the metal mold 6 and the like, and the degassing gaps formed in the metal mold 21 (See FIG. 4) are unnecessary.

Figure 12:
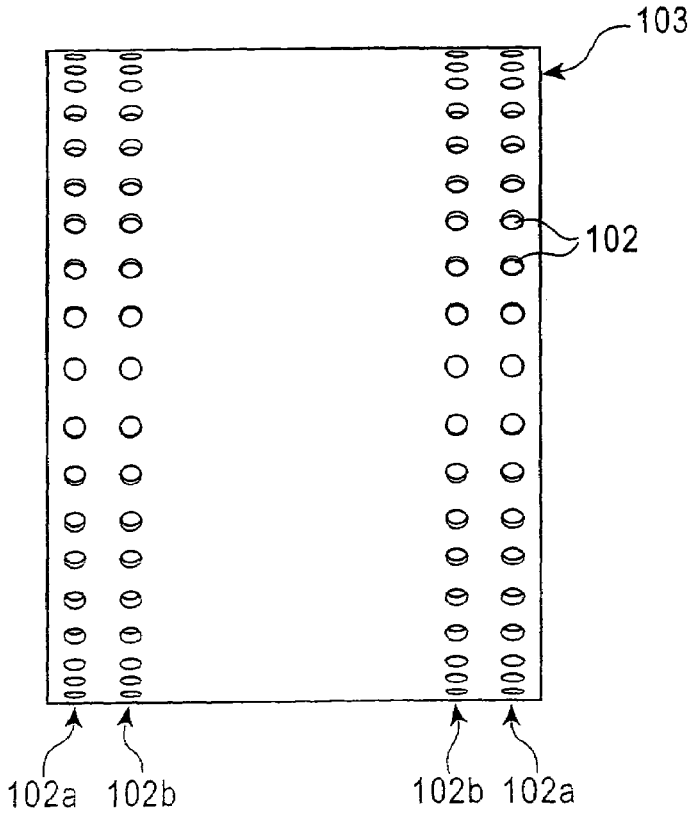
FIG. 12 is a front view of another base ring used for the present invention.

FIG. 12 illustrates a base ring 103 having a large number of holes 102 formed in the circumferential wall along the circumferential direction at both end portions in the axial direction in a symmetric manner. These holes 102 are arranged in two hole lines (an outer hole line 102*a* and an inner hole line 102*b*) making a circuit of the circumferential wall at both end portions in the axial direction, and are disposed at regular intervals in the hole lines 102*a* and 102*b*. This base ring 103 can be produced by roll-bending a rectangular metal plate (for example, a plate of an aluminum alloy) having the plurality of holes 102 arranged in two lines in parallel adjacent to the end portions in the axial direction along the circumferential direction, and by connecting the ends by welding or the like.

Figure 13B:
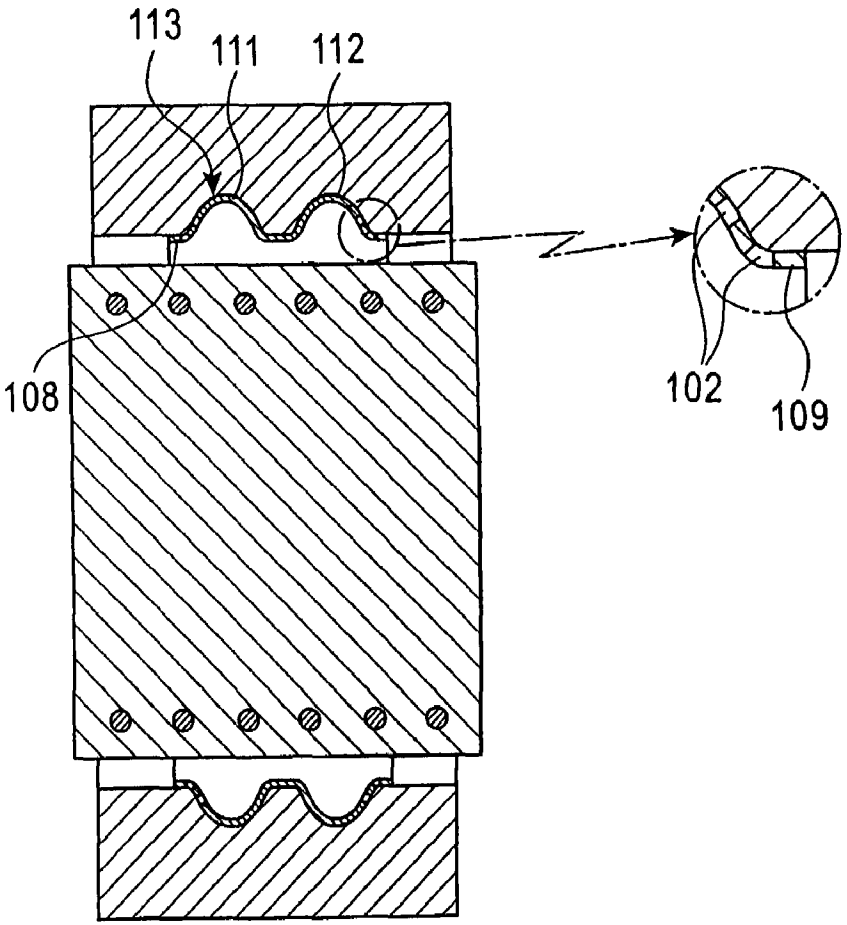
FIGS. 13(*a*) and 13(*b*) are cross-sectional views before and after molding, respectively, illustrating a method for manufacturing a cylindrical ring with beads using the above-described base ring.
Figure 13A:
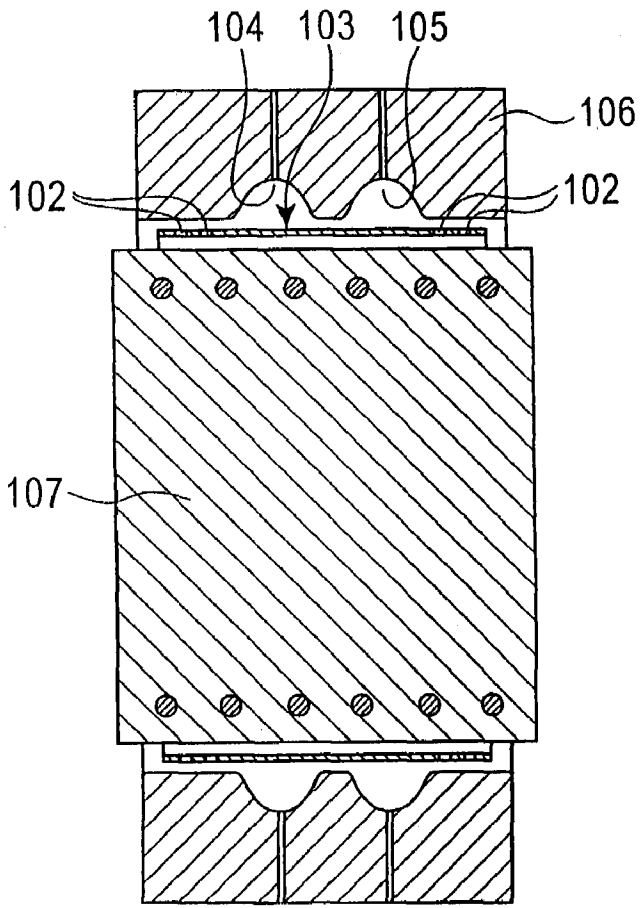

FIG. 13 illustrates a method for molding this base ring 103 by electromagnetic forming. In FIG. 13(*a*), a metal mold 106 (formed of a plurality of pieces separable in the circumferential direction as in the case for the metal mold 6) is disposed adjacent to the outer circumference of the base ring 103, and has a molding face in the inner circumference and grooves 104 and 105 for forming beads on the molding face along the circumferential direction. A coil component 107 for electromagnetic forming is disposed adjacent to the inner circumference of the base ring 103. The molding face of the metal mold 106 is substantially rotationally symmetrical with respect to the central axis, and is substantially symmetrical with respect to a plane vertical to the axial direction at the central position of the axial direction. Moreover, the central position of the molding face of the metal mold 106 in the axial direction corresponds to that of the base ring 103 in the axial direction.

When a momentary large current is applied to the coil component 107 in the state shown in FIG. 13(*a*), a force by magnetic repulsion is generated at the base ring 103. The diameter of the base ring 103 is then expanded, and the base ring 103 is pressed toward the molding face of the metal mold 106 at that moment. Thus, as shown in FIG. 13(*b*), the base ring 103 is molded into a shape along the molding face so as to be a cylindrical ring 113 with beads. The cylindrical ring 113 includes short parallel portions 108 and 109 at both ends in the axial direction and two beads 111 and 112 (the beads 111 and 112 are undulated abreast with each other) convexed in the radial direction along the circumferential direction between the parallel portions 108 and 109. This cylindrical ring 113 is substantially rotationally symmetrical with respect to the central axis (although the cylindrical ring is not rotationally symmetrical with respect to the central axis in the strict sense of the word due to, for example, the holes 102, the cylindrical ring can be substantially regarded to be rotationally symmetrical with respect to the central axis in consideration of the profile thereof), and is substantially symmetrical with respect to a plane vertical to the axial direction at the central position of the axial direction.

The base ring 103 is pressed into the grooves 104 and 105 by the electromagnetic forming, and as a result, portions of the base ring 103 located at outer positions of the grooves 104 and 105 in the axial direction enter the grooves 104 and 105. Before molding, the holes 102 of the base ring 103 in both hole lines (the hole lines 102*a* and 102*b*) are located at the outer positions of the grooves 104 and 105 of the molding face of the metal mold 106. However, when the portions of the base ring 103 at both ends enter the grooves 104 and 105, the hole lines 102*b* are located in the grooves 104 and 105. In other words, in the base ring 103, the hole lines 102*b* disposed at the inner positions in the axial direction are located on the beads 111 and 112, and the hole lines 102*a* disposed at the outer positions in the axial direction are located adjacent to borders between the parallel portion 108 and the bead 111 and between the parallel portion 109 and the bead 112.

When the end portions of the base ring 103 enter the grooves 104 and 105 from the parallel end portions of the metal mold 106, frictional resistance between the molding face of the metal mold 106 and the base ring 103 is reduced since the contact area therebetween is reduced due to the holes 102 compared with the base ring 1 and the like having no holes. As a result, the base ring 103 can smoothly enter the grooves 104 and 105, and the electromagnetic forming can be accurately performed. Substantially the same effect as this can be accomplished also with the base ring 101.

Figure 14:
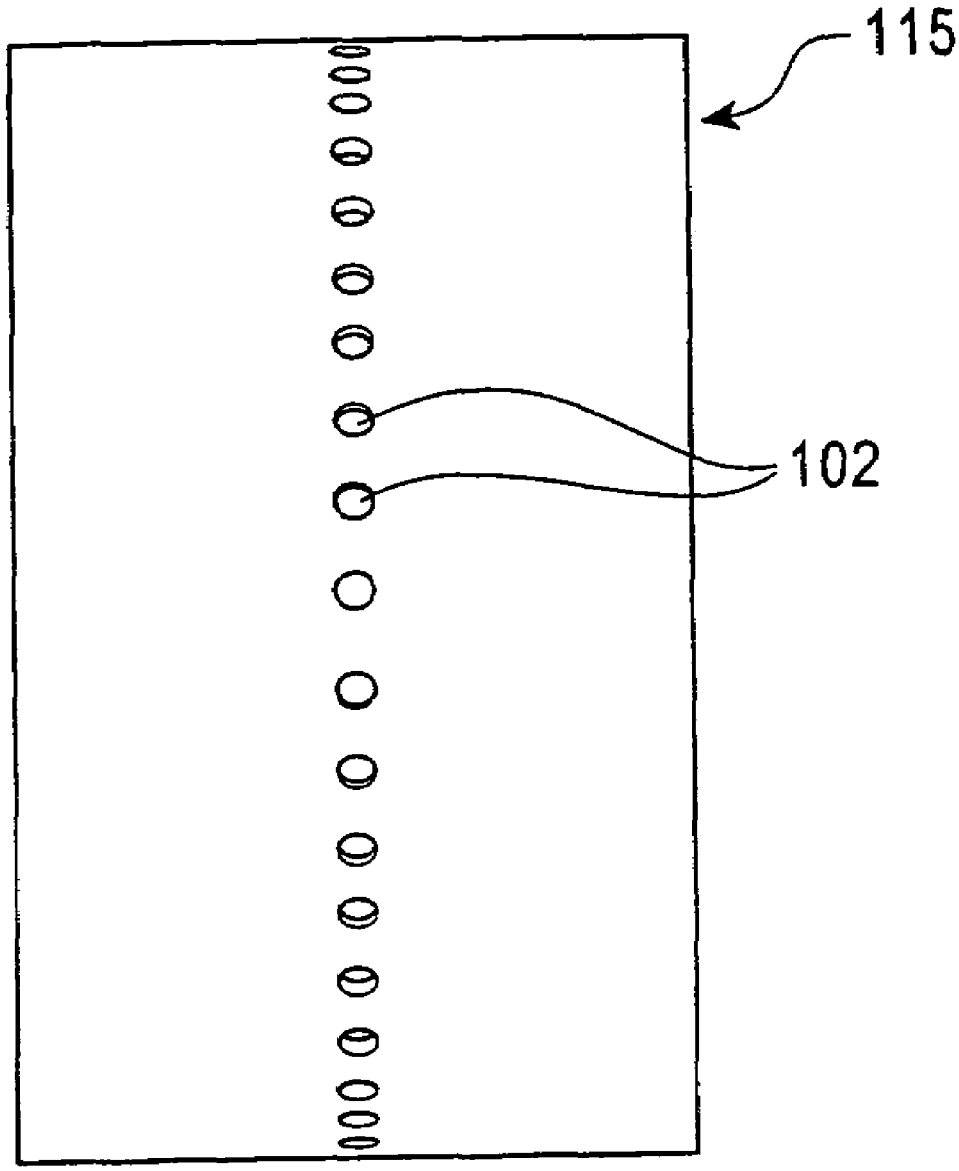
FIG. 14 is a front view of another base ring used for the present invention.

FIG. 14 illustrates a base ring 115 having a line of a large number of holes 102 formed in the middle position in the axial direction along the circumferential direction at regular intervals. This base ring 115 can be produced by roll-bending a rectangular metal plate (for example, a plate of an aluminum alloy) having the plurality of holes 102 disposed in one line, and by connecting the ends by welding or the like.

Figure 15A:
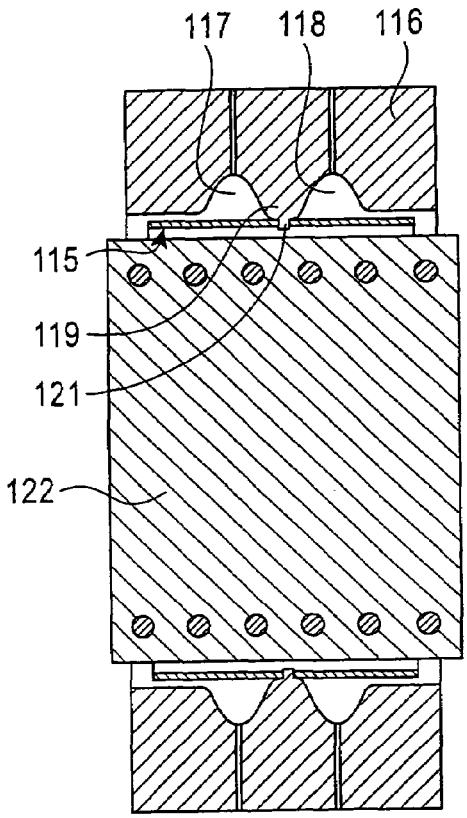
FIGS. 15(*a*) and 15(*b*) are cross-sectional views before and after molding, respectively, illustrating a method for manufacturing a cylindrical ring with beads using the above-described base ring.
Figure 15B:
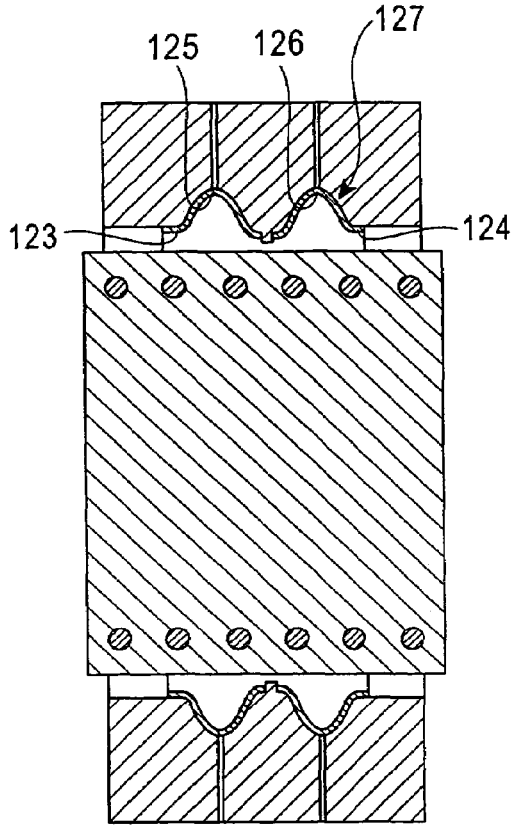

FIG. 15 illustrates a method for molding this base ring 115 by electromagnetic forming. In FIG. 15(*a*), a metal mold 116 (formed of a plurality of pieces separable in the circumferential direction as in the case for the metal mold 6) is disposed adjacent to the outer circumference of the base ring 115, and has a molding face in the inner circumference and grooves 117 and 118 for forming beads on the molding face along the circumferential direction. The intermediate portion 119 between the grooves 117 and 118 protrudes inward, and projections 121 are formed along the circumferential direction at the top of the intermediate portion 119 where the internal diameter is the smallest at regular intervals. The molding face of the metal mold 116 is substantially rotationally symmetrical with respect to the central axis (although the molding face is not rotationally symmetrical with respect to the central axis in the strict sense of the word due to, for example, projections 121, the molding face can be substantially regarded to be rotationally symmetrical with respect to the central axis in terms of the functionality), and is substantially symmetrical with respect to a plane vertical to the axial direction at the central position of the axial direction.

The intervals between two adjacent projections 121 of the metal mold 116 correspond to the intervals between two adjacent holes 102 of the base ring 115. Also, when the metal mold 116 is disposed around the base ring 115, the internal diameter of the top of the intermediate portion 119 substantially corresponds to the external diameter of the base ring 115 such that the projections 121 are fitted in the holes 102, and the molding face of the metal mold 116 is in contact with the outer circumference of the base ring 115 at the top of the intermediate portion 119.

When a momentary large current is applied to a coil component 122 for electromagnetic forming in the state shown in FIG. 15(*a*), a force by magnetic repulsion is generated at the base ring 115. The diameter of the base ring 115 is then expanded, and the base ring 115 is pressed toward the molding face of the metal mold 116 at that moment. Thus, as shown in FIG. 15(*b*), the base ring 115 is molded into a shape along the molding face so as to be a cylindrical ring 127 with beads. The cylindrical ring 127 includes short parallel portions 123 and 124 at both ends in the axial direction and two beads 125 and 126 (both the beads 125 and 126 are undulated abreast with each other) convexed in the radial direction along the circumferential direction between the parallel portions 123 and 124. This cylindrical ring 127 is substantially rotationally symmetrical with respect to the central axis, and is substantially symmetrical with respect to a plane vertical to the axial direction at the central position of the axial direction.

The base ring 115 is accurately positioned in the metal mold 116 by fitting the projections 121 of the metal mold 116 into the holes 102 of the base ring 115. Accordingly, the middle portion of the base ring 115 also does not move in the axial direction during electromagnetic forming, and the molding can be performed accurately.

When the diameter of the base ring 115 is reduced by electromagnetic forming (a metal mold is disposed inside the base ring 115), projections to be fitted into the holes 102 of the base ring 115 are formed at positions where the external diameter of the molding face of the metal mold is the largest. The projections are desirably formed at the middle position in the axial direction as in the case for the above-described metal mold 116. In addition, when the metal mold is disposed inside the base ring 115, the external diameter of the molding face substantially corresponds to the internal diameter of the base ring 115.

The holes 102 of the base ring 101 formed in the circumferential direction (in particular, the hole lines in the center or adjacent to the center) can also be available for positioning.

Figure 16:
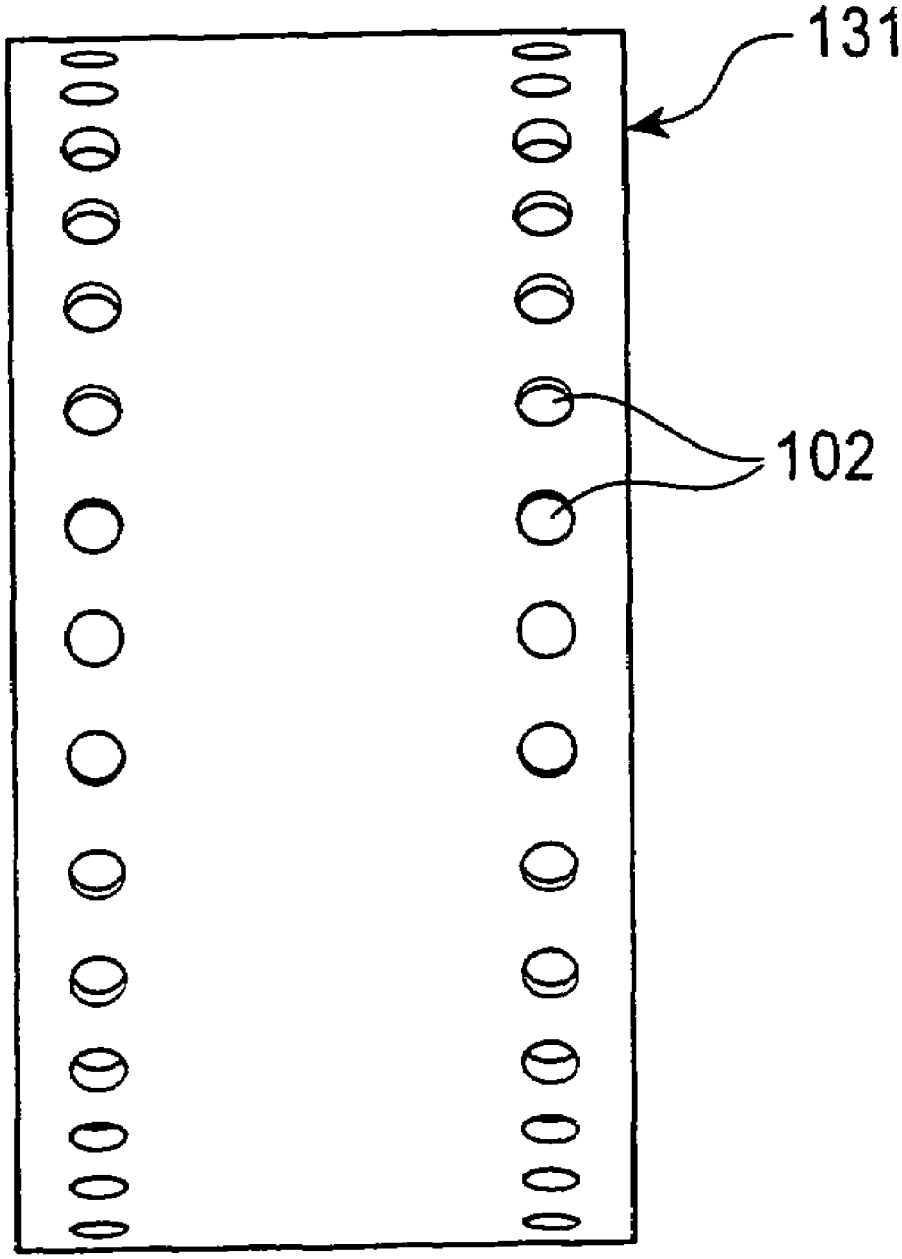
FIG. 16 is a front view of another base ring used for the present invention.
Figure 17A:
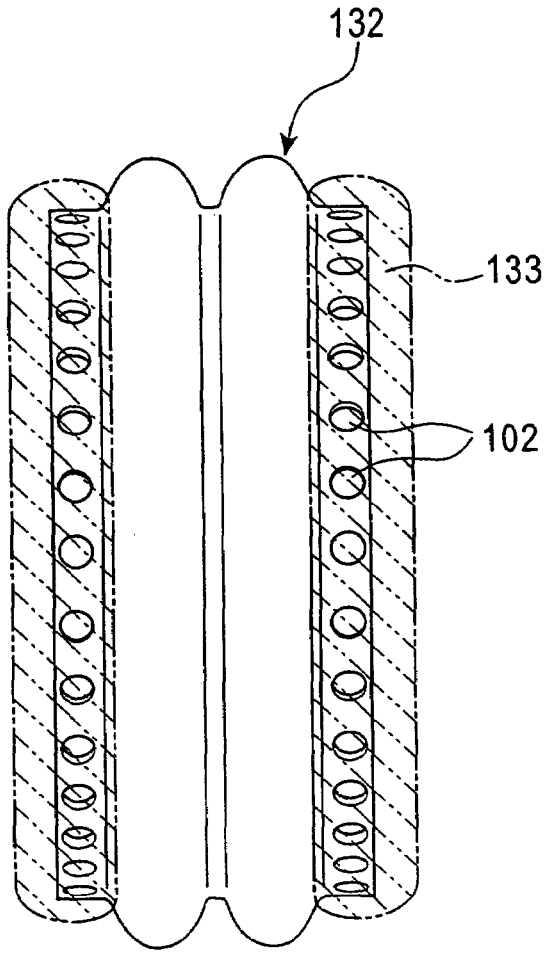
FIG. 17(*a*) is a front view of a cylindrical ring with beads molded using the above-described base ring, and FIG. 17(*b*) is a cross-sectional view illustrating a state after the cylindrical ring is connected by resin.
Figure 17B:
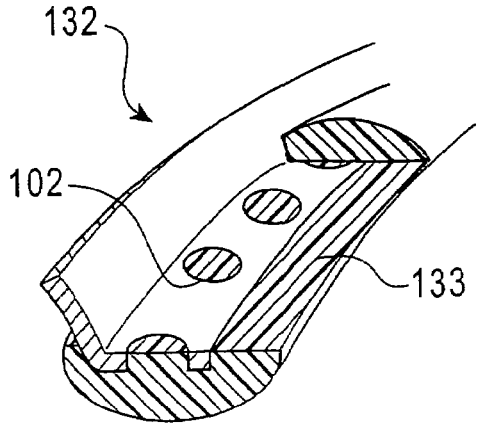

FIG. 16 illustrates a base ring 131 having a line of a large number of holes 102 formed at each end portion in the axial direction along the circumferential direction at regular intervals. A cylindrical ring 132 with beads (indicated by solid lines) shown in FIG. 17(*a*) is produced by molding the base ring 131 by electromagnetic forming using the metal mold 106 shown in FIG. 13. As indicated by virtual lines in FIG. 17(*a*), resin 133 is melted and attached to this cylindrical ring 132 at both end portions in the axial direction. The resin 133 flows in the holes 102 as shown in FIG. 17(*b*), and thus the cylindrical ring 132 and the resin 133 are firmly connected.

The same effect as this can be accomplished also with the base rings 101 and 103.

Figure 18A:
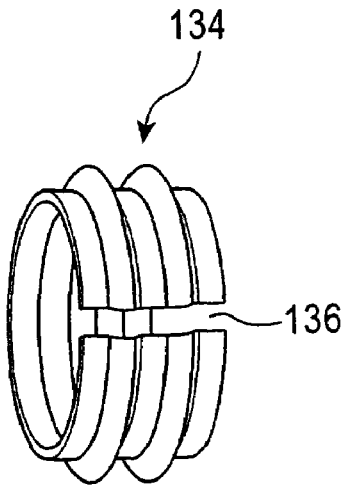
FIGS. 18(*a*) and 18(*b*) are perspective views of cylindrical rings with beads cut off in the circumferential direction.
Figure 18B:
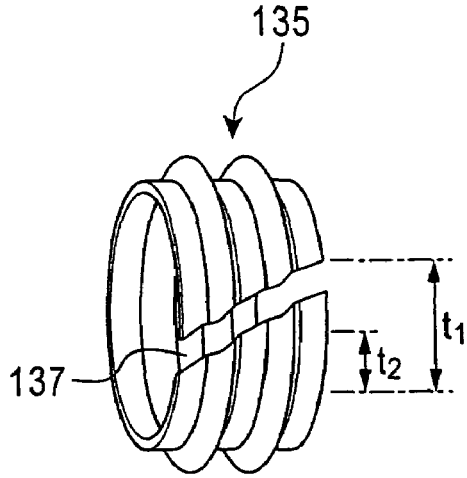

FIGS. 18(*a*) and 18(*b*) illustrate cylindrical rings with beads that are molded by electromagnetic forming and then cut off in the circumferential direction. The cutting directions are parallel to the axial direction in FIG. 18(*a*) and inclined to the axial direction in FIG. 18(*b*), respectively. These cylindrical rings 134 and 135 with beads can be linked together through respective cut-off portions (splits 136 and 137).

Figure 19A:
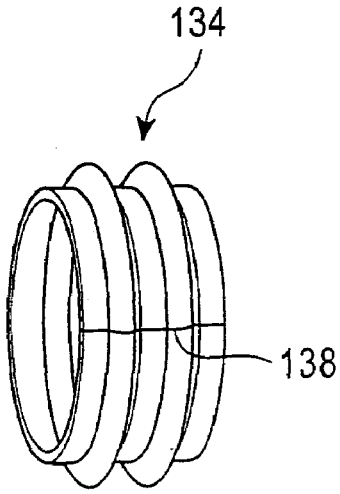
FIGS. 19(*a*) and 19(*b*) are perspective views of the cylindrical rings reconnected by welding after being cut off.
Figure 19B:
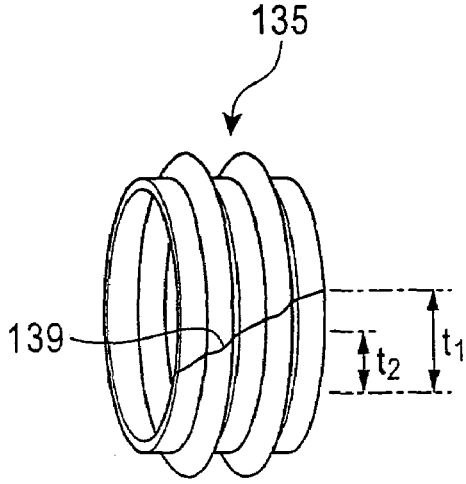

The cut-off portions of these cylindrical rings 134 and 135 can be reconnected by welding or the like, if necessary. FIGS. 19(*a*) and 19(*b*) illustrate the cylindrical rings 134 and 135 that are reconnected by welding (welds 138 and 139).

The cylindrical rings 134 and 135 may be used both in the state where the cylindrical rings are cut off in the circumferential direction (See FIG. 18) and in the state where the cut-off portions are reconnected (See FIG. 19). It is desirable in some applications that the cutting direction be inclined to the axial direction. For example, when the cylindrical ring 135 having the inclined cutting portion is used as a reinforced ring for a run-flat tire and the length t1 of the split 137 or the weld 139 in the circumferential direction is larger than the width t0 of a contact surface in the circumferential direction, the load of the total car weight is not concentrated on the entire split 137 or the entire weld 139 having relatively low strength at one time.

When a cylindrical ring with beads having a plurality of holes is cut off in the circumferential direction and is then reconnected, the above-described holes 102 can be used for the connection. This will be described with reference to the cylindrical ring 132 as an example.

Figure 20A:
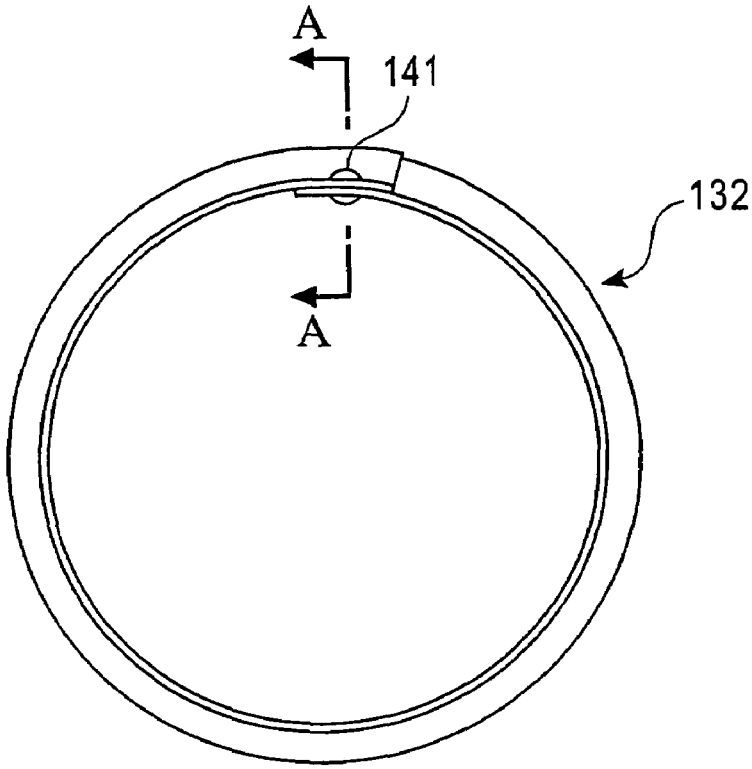
FIGS. 20(*a*) and 20(*b*) are a side view and a cross-sectional view taken along line A-A in FIG. 20(*a*), respectively, of the cylindrical ring reconnected by rivets after being cut off.
Figure 20B:
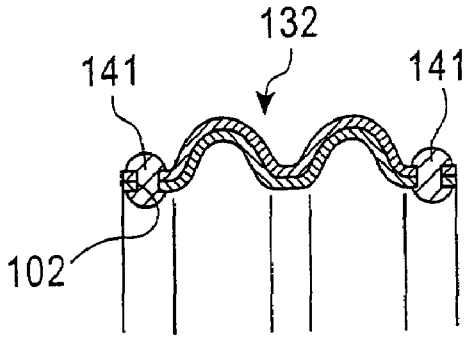

FIG. 20 illustrates the cylindrical ring 132 that is cut off in the circumferential direction and is then connected by rivets 141 at the end portions partly overlapped. The rivets 141 pass through the overlapped holes 102 so as to connect the end portions.

Figure 21A:
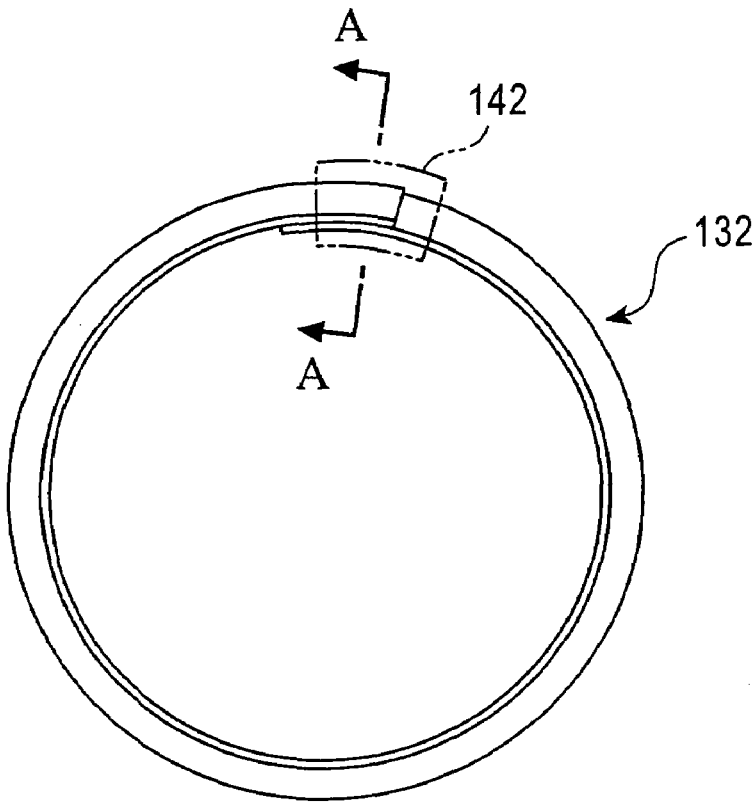
FIGS. 21(*a*) and 21(*b*) are a side view and a cross-sectional view taken along line A-A in FIG. 21(*a*), respectively, of the cylindrical ring reconnected by resin after being cut off.
Figure 21B:
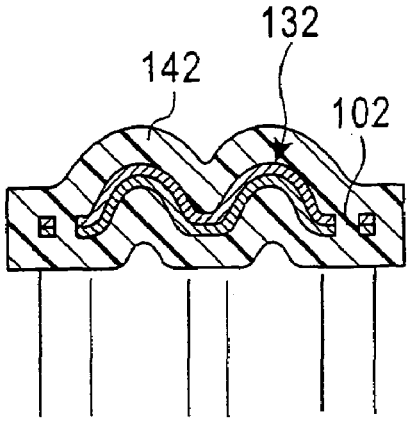

FIG. 21 illustrates the cylindrical ring 132 that is cut off in the circumferential direction and is then connected by melted resin 142 at the end portions partly overlapped. The resin 142 flows into the overlapped holes 102, and is cured to connect the end portions.

Figure 22A:
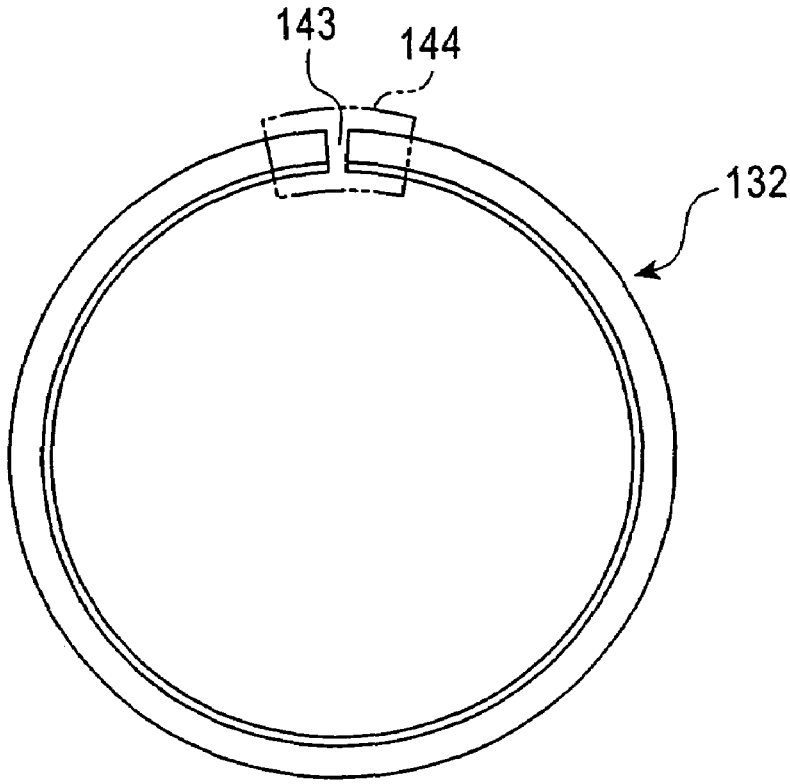
FIGS. 22(*a*) and 22(*b*) are a side view and a cross-sectional view taken along line A-A in FIG. 22(*a*), respectively, of the cylindrical ring reconnected by resin after being the cut off.
Figure 22B:
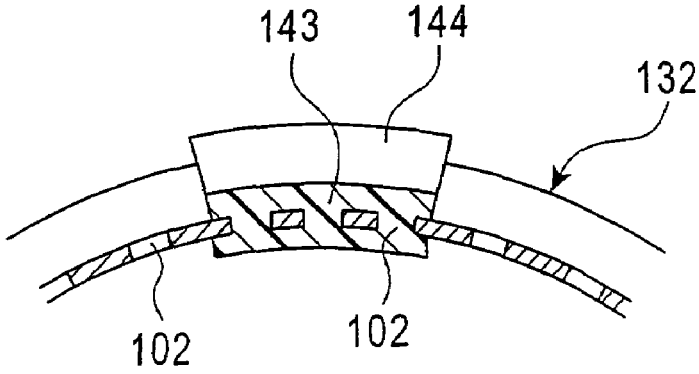

FIG. 22 illustrates the cylindrical ring 132 that is cut off in the circumferential direction so as to form an open split 143 and is then connected by melted resin 144 at the split 143. The resin 144 flows into the overlapped holes 102, and is cured to connect the end portions. In this case, the end portions may be connected by the resin 144 while the split 143 is closed.

Figure 23A:
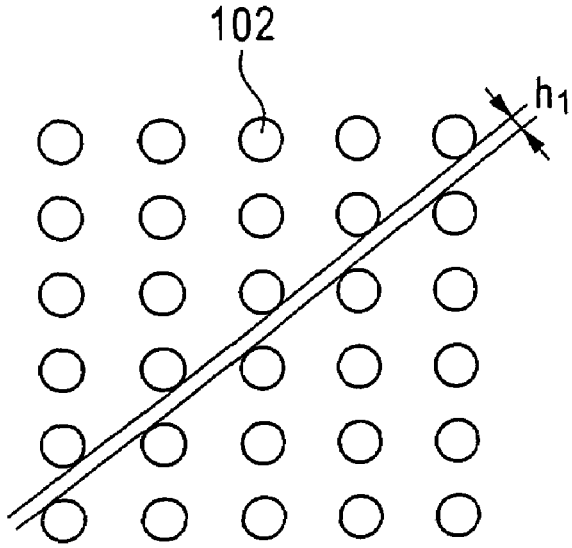
FIGS. 23(*a*) and 23(*b*) are schematic views illustrating the arrangement of the holes and gaps between two adjacent hole lines when a cylindrical ring with beads having a large number of holes is cut off in the circumferential direction.
Figure 23B:
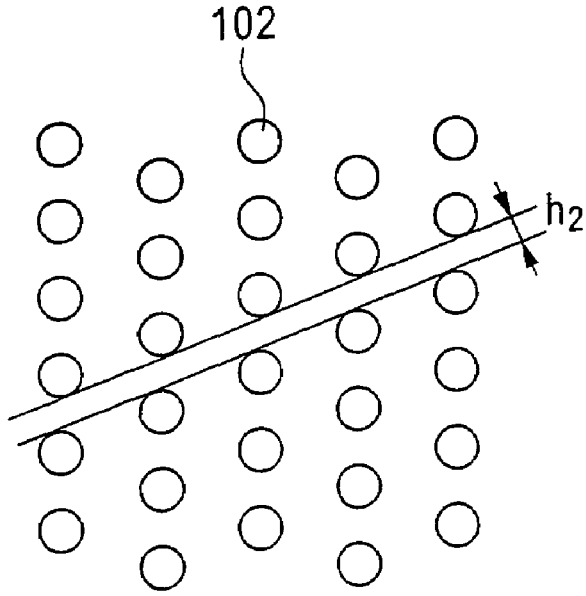

When a cylindrical ring with beads having a plurality of holes is cut off in the circumferential direction, in particular, when the cutting line is inclined to the axial direction, it is sometimes desirable that the plurality of holes 102 be in a staggered arrangement (the positions of the holes 102 of two adjacent hole lines are shifted by half a pitch in the circumferential direction) shown in FIG. 23(*b*) rather than a grid arrangement (See the base ring 101 in FIG. 11) shown in FIG. 23(*a*). It is because, when viewing oblique hole lines formed of the plurality of holes 102, the gaps (h2) between two adjacent hole lines in the staggered arrangement can be made wider than the gaps (h1) in the grid arrangement (h2>h1) as shown in FIGS. 23(*a*) and 23(*b*). As a result, the cylindrical ring having the holes in the staggered arrangement can be cut more easily, and can also be weld more easily when it is reconnected.

Figure 24A:
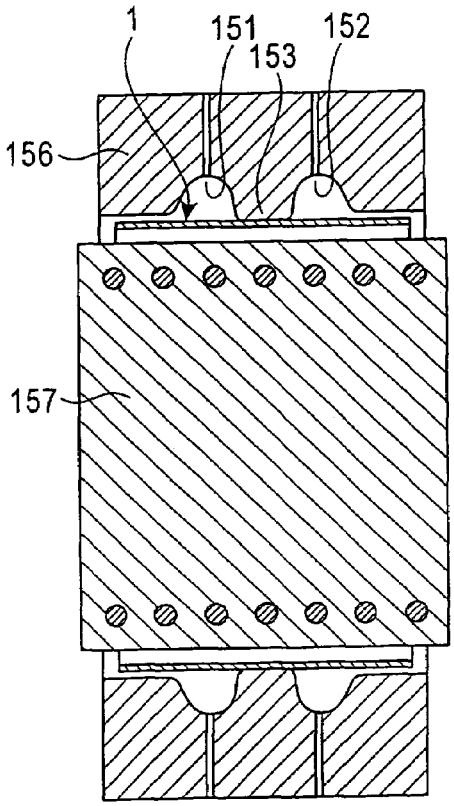
FIGS. 24(*a*) and 24(*b*) are cross-sectional views before and after molding, respectively, illustrating a method for manufacturing a cylindrical ring with beads by electromagnetic forming.
Figure 24B:
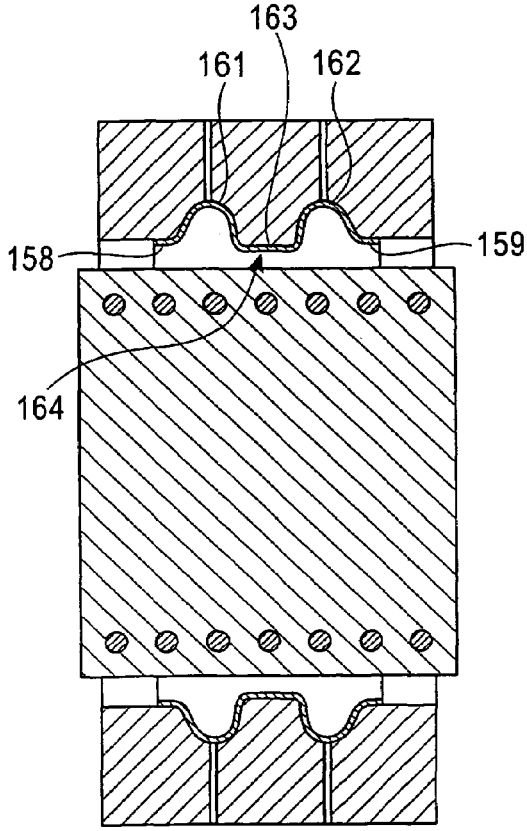
Figure 25A:
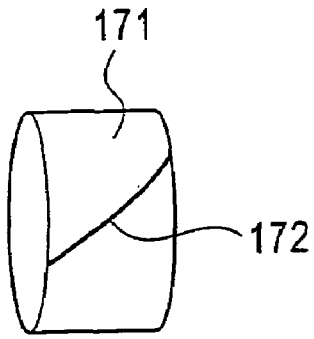
FIGS. 25(*a*) to 25(*d*) illustrate methods for producing base rings.
Figure 25B:
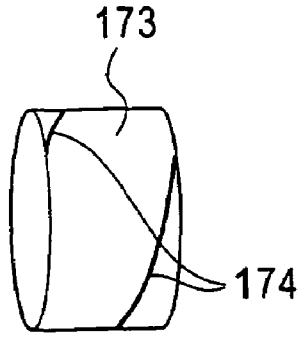
Figure 25C:
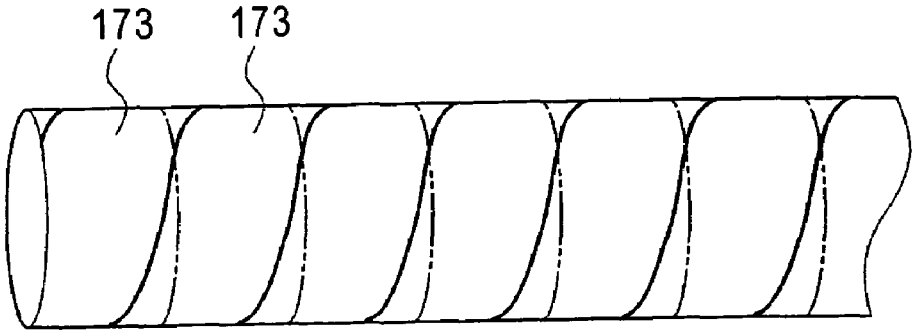
Figure 25D:
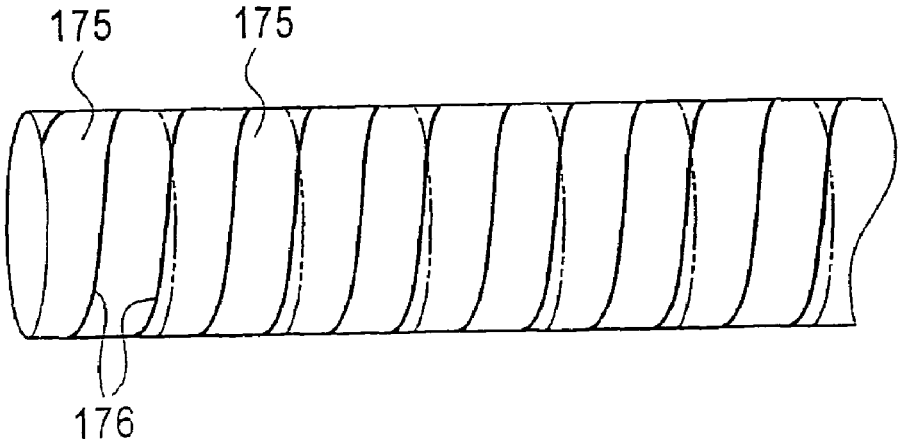

FIG. 24 illustrates a method for molding the base ring 1 by electromagnetic forming using a metal mold 156 (formed of a plurality of pieces separable in the circumferential direction as in the case for the metal mold 6). The metal mold 156 is similar to the metal mold 106. The metal mold 156 has a molding face in the inner circumference, and has grooves 151 and 152 for forming beads on the molding face along the circumferential direction. The intermediate portion 153 of the grooves 151 and 152 protrudes inward, and the internal diameter of the molding face is the smallest at the intermediate portion 153. The molding face of the metal mold 156 is substantially rotationally symmetrical with respect to the central axis, and is substantially symmetrical with respect to a plane vertical to the axial direction at the central position of the metal mold 156 in the axial direction.

As shown in FIG. 24(*a*), the base ring 1 is disposed inside the metal mold 106, and furthermore, a coil component 157 for electromagnetic forming is disposed adjacent to the inner circumference of the base ring 1. The external diameter of the base ring 1 substantially corresponds to the internal diameter of the intermediate portion 153 of the metal mold 106, and the molding face of the metal mold 156 is in contact with the outer circumference of the base ring 1 in the intermediate portion 153. In addition, the central position of the molding face of the metal mold 156 in the axial direction corresponds to the central position of the base ring 1 in the axial direction.

When a momentary large current is applied to the coil component 157 in the state shown in FIG. 24(*a*), a force by magnetic repulsion is generated at the base ring 1. The diameter of the base ring 1 is then expanded, and the base ring 1 is pressed toward the molding face of the metal mold 156 at that moment. Thus, as shown in FIG. 24(*b*), the base ring 1 is molded into a shape along the molding face so as to be a cylindrical ring 164 with beads. The cylindrical ring 164 includes short parallel portions 158 and 159 at both ends in the axial direction and two beads 161 and 162 (both the beads 161 and 162 are undulated together with a small-diameter portion 163 therebetween) convexed in the radial direction along the circumferential direction between the parallel portions 158 and 159. This cylindrical ring 164 is substantially rotationally symmetrical with respect to the central axis, and is substantially symmetrical with respect to a plane vertical to the axial direction at the central position of the axial direction.

When using this method, since the middle position of the base ring 1 in the axial direction is positioned at the intermediate portion 153 (the middle position of the molding face in the axial direction) where the internal diameter of the molding face of the metal mold 156 is the smallest, more uniform molding can be performed.

FIGS. 25(*a*) to 25(*d*) illustrate a method for manufacturing a base ring. A base ring 171 shown in FIG. 25(*a*) is different from the above-described base ring 1 in terms of a connecting portion (weld bead) 172 oblique to the axial direction by butt welding. Due to the oblique connecting portion 172, weight balance of the base ring 171 in the circumferential direction is improved compared with the base ring 1 having the connecting portion 2 parallel to the axial direction.

A base ring 173 shown in FIG. 25(*b*) is formed by spirally curling a rolled plate and connecting the joints, and has a connecting portion (weld bead) 174 making a circuit of the cylinder. Although the connecting portion of the base ring 173 is long, weight balance of the base ring 173 in the circumferential direction is excellent.

FIG. 25(*c*) illustrates a method for manufacturing a plurality of base rings 173 by producing a spiral tube in advance by spirally curling a rolled plate and connecting the joints, and by cutting the tube to a predetermined length (cutting positions are indicated by virtual lines).

FIG. 25(*d*) illustrates a method for manufacturing a plurality of base rings 175 by producing a spiral tube having a dense connecting portion 176, and by cutting the tube to a predetermined length (cutting positions are indicated by virtual lines). Although the connecting portions 176 of these base rings 175 are made longer, weight balance of the base rings 175 in the circumferential direction is excellent.

EXAMPLE

A base ring similar to that shown in FIG. 1 was molded from a plate of an aluminum alloy, and a cylindrical ring with beads was produced by molding the base ring by electromagnetic forming.

The aluminum-alloy plate as a raw material was an extruded plate (type 6061-F). The plate was formed into a cylinder by roll-bending using three rolls such that the extruding direction corresponded to the feeding direction of the roll-bending, and the ends were butt-welded (the connecting portion was parallel to the central axis direction of the ring). The cylindrical ring had a thickness of 2.2 mm, an internal diameter of 494 mm, and a width of 222 mm in the axial direction. For welding, laser welding and MIG welding were performed. The laser welding was performed under a condition with a power of 40 kW, a speed of 3 m/min, a wire A5356WY with a diameter of 1.2 mm, a feeding speed of 4 m/min, and an atmospheric gas of 100% argon supplied at 25 l/min. The MIG welding was performed under a condition with a current of 80 A, a voltage of 18 V, a wire A5356WY with a diameter of 1.2 mm, a feeding speed of 60 cm/min, and an atmospheric gas of 100% argon supplied at 15 l/min.

Then, this base ring was molded by electromagnetic forming (flaring) using a metal mold and a coil component for electromagnetic forming similar to those shown in FIG. 4. The minimum diameter of the molding face of the metal mold (the diameter between parallel portions at both ends) was 504 mm, the diameter of the coil component was 490 mm, and the length of the stabilized magnetic-field area of the coil component (the area where substantially the same magnetic flux density is obtained) was 250 mm. The cylindrical ring was disposed in the center of this stabilized magnetic-field area, and the applied energy was 45 kJ.

Figure 2A:
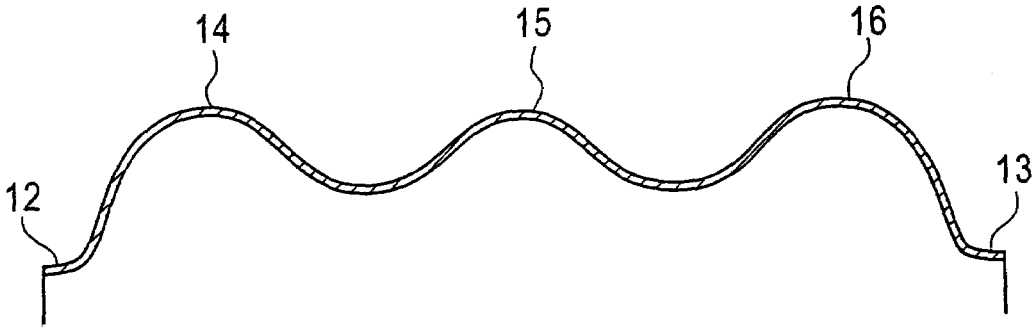
FIGS. 2(*a*), 2(*b*), and 2(*c*) are a cross-sectional view, a side view, and a front view, respectively, of a cylindrical ring with beads after electromagnetic forming.
Figure 2B:
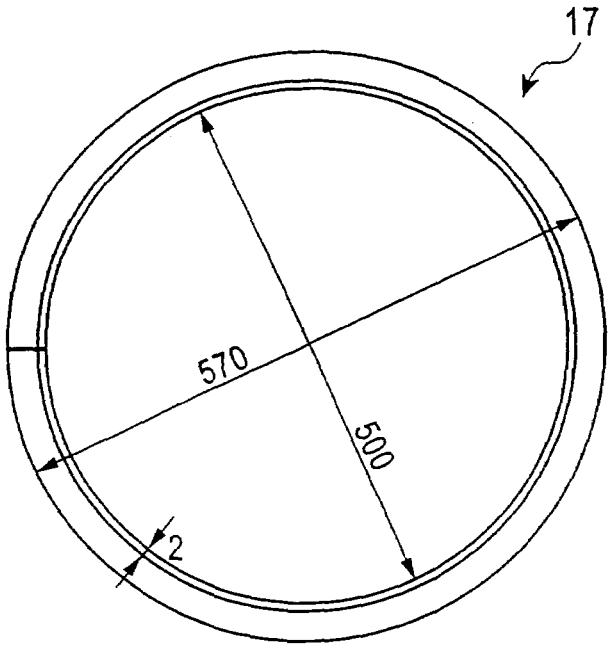
Figure 2C:
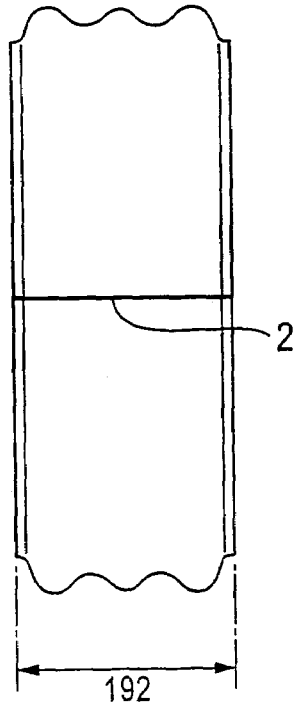

FIG. 2 illustrates a cylindrical ring with beads molded by electromagnetic forming. In both welding methods, the cylindrical ring had an internal diameter of 500 mm, an external diameter of 570 mm, a thickness of 2 mm at the ends, and a width of 192 mm in the axial direction; and was molded into a shape along the molding face of the metal mold without any dents on the beads.

INDUSTRIAL APPLICABILITY

According to the present invention, an accurate cylindrical ring with beads can be produced by electromagnetic forming at low cost and with high productivity. Furthermore, the cylindrical ring molded by flaring has excellent properties as a reinforced ring especially for a flat tire.

The invention claimed is:

1. A method for manufacturing a cylindrical ring with beads, comprising the steps of:

disposing a metal mold adjacent to the outer circumference or the inner circumference of a closed metallic base ring, the metal mold having a molding face that faces the base ring and having grooves for forming the beads on the molding face along the circumferential direction;

disposing a coil for electromagnetic forming at the opposite side of the metal mold such that the base ring is interposed therebetween;

applying a momentary large current to the coil in this arrangement;

deforming the base ring by pressing the base ring toward the molding face of the metal mold such that the base ring is molded into a shape corresponding to the molding face by electromagnetic forming, wherein an inner roll and an outer roll whose outer dimensions are finished with a required accuracy are prepared; and correcting the cylindrical ring with the beads molded into the shape corresponding to the molding face by electromagnetic forming by rotating the rolls while interposing the cylindrical ring between the inner roll and the outer roll.

2. The method for manufacturing the cylindrical ring with the beads according to claim 1, wherein at least one of the inner roll and the outer roll has a cutting blade, including the step of using the cutting blade to cut the cylindrical ring with the beads when the cylindrical ring with the beads is pressed toward the roll having the cutting blade.

3. A method for manufacturing a cylindrical ring with beads, comprising the steps of:

disposing a metal mold adjacent to the outer circumference or the inner circumference of a closed metallic base ring, the metal mold having a molding face that faces the base ring and having grooves for forming the beads on the molding face along the circumferential direction;

disposing a coil for electromagnetic forming at the opposite side of the metal mold such that the base ring is interposed therebetween;

applying a momentary large current to the coil in this arrangement; and deforming the base ring by pressing the base ring toward the molding face of the metal mold such that the base ring is molded into a shape corresponding to the molding face by electromagnetic forming, wherein the metal mold has a circular cutting blade vertical to the axial direction; and cutting the base ring using the cutting blade when the base ring is pressed toward the molding face of the metal mold.

4. A method for manufacturing a cylindrical ring with beads, comprising the steps of:

disposing a metal mold adjacent to the outer circumference or the inner circumference of a closed metallic base ring, the metal mold having a molding face that faces the base ring and having grooves for forming the beads on the molding face along the circumferential direction;

disposing a coil for electromagnetic forming at the opposite side of the metal mold such that the base ring is interposed therebetween;

applying a momentary large current to the coil in this arrangement; and deforming the base ring by pressing the base ring toward the molding face of the metal mold such that the base ring is molded into a shape corresponding to the molding face by electromagnetic forming, wherein the base ring has a large number of holes in the circumferential wall.

5. The method for manufacturing the cylindrical ring with the beads according to claim 4, wherein the large number of holes are formed in the base ring along the circumferential direction at positions where portions of the base ring enter the interior of the grooves from the exterior of the grooves of the molding face of the metal mold in electromagnetic forming.

6. The method for manufacturing the cylindrical ring with the beads according to claim 4, wherein the large number of holes are formed in the base ring along the circumferential direction at both end portions of the base ring in the axial direction.

7. A method for manufacturing a cylindrical ring with beads, comprising the steps of:

disposing a metal mold adjacent to the outer circumference or the inner circumference of a closed metallic base ring, the metal mold having a molding face that faces the base ring and having grooves for forming the beads on the molding face along the circumferential direction;

disposing a coil for electromagnetic forming at the opposite side of the metal mold such that the base ring is interposed therebetween;

applying a momentary large current to the coil in this arrangement; and deforming the base ring by pressing the base ring toward the molding face of the metal mold such that the base ring is molded into a shape corresponding to the molding face by electromagnetic forming, wherein a large number of projections are formed in the molding face of the metal mold along the circumferential direction at positions nearest to the base ring;

a large number of holes are formed in the base ring along the circumferential direction at positions corresponding to the projections; and the projections are fitted into the holes when the metal mold is put in position.

8. The method for manufacturing the cylindrical ring with the beads according to claim 7, wherein the projections are formed between two adjacent grooves on the molding face at the central position of the molding face of the metal mold in the axial direction; and the holes are formed at the central position of the base ring in the axial direction.

9. A metal mold for molding a cylindrical ring with beads by electromagnetic forming, comprising:

a ring-shaped molding face on the inner surface or the outer surface; and grooves for forming the beads on the molding face along the circumferential direction, wherein the metal mold has a circular cutting blade vertical to the axial direction of the molding face.

10. A metal mold for molding a cylindrical ring with beads by electromagnetic forming, comprising:

a ring-shaped molding face on the inner surface or the outer surface; and grooves for forming the beads on the molding face along the circumferential direction, wherein the metal mold further has a large number of positioning projections on the molding face along the circumferential direction at positions nearest to the base ring to be molded.

* * * * *